US009206729B2

(12) United States Patent
Mungas et al.

(10) Patent No.: US 9,206,729 B2
(45) Date of Patent: Dec. 8, 2015

(54) THROTTLEABLE EXHAUST VENTURI

(76) Inventors: Gregory S. Mungas, Mojave, CA (US); Larry R. Buchanan, La Habra, CA (US); Jose T. Banzon, Jr., Glendale, CA (US)

( * ) Notice: Subject to any disclaimer, the term of this patent is extended or adjusted under 35 U.S.C. 154(b) by 133 days.

(21) Appl. No.: 13/458,684

(22) Filed: Apr. 27, 2012

(65) Prior Publication Data

US 2012/0272651 A1 Nov. 1, 2012

Related U.S. Application Data

(60) Provisional application No. 61/480,835, filed on Apr. 29, 2011.

(51) Int. Cl.

| | |
|---|---|
| ***F01N 3/02*** | (2006.01) |
| ***F01N 13/08*** | (2010.01) |
| ***F01N 13/20*** | (2010.01) |

(52) U.S. Cl.

CPC ..... *F01N 13/082* (2013.01); *F01N 13/20* (2013.01); *F01N 2260/06* (2013.01); *F01N 2270/08* (2013.01)

(58) Field of Classification Search

CPC ..... F01N 13/20; F01N 13/082
USPC ..... 60/689, 315–317, 319, 322, 324; 181/262

See application file for complete search history.

(56) References Cited

U.S. PATENT DOCUMENTS

| | | | |
|---|---|---|---|
| 1,560,947 | A | 11/1925 | Skelton |
| 3,241,316 | A | 3/1966 | Endres |
| 3,470,689 | A | 10/1969 | Gurr |
| 4,313,523 | A | 2/1982 | Copen |
| 4,335,575 | A | 6/1982 | Pagliuca |
| 5,282,361 | A | 2/1994 | Sung |
| 5,524,434 | A | 6/1996 | Ma |
| 6,167,700 | B1 | 1/2001 | Lampert |
| 7,637,099 | B2 | 12/2009 | Ranganathan et al. |

(Continued)

FOREIGN PATENT DOCUMENTS

| | | |
|---|---|---|
| EP | 1770249 A1 | 4/2007 |
| JP | 10-238342 A | 9/1998 |

(Continued)

OTHER PUBLICATIONS

Chang, Junseok et al., New Heat Transfer Correlation for an HCCI Engine Derived from Measurements of Instantaneous Surface Heat Flux, Society of Automotive Engineers, Inc. 2004, 18 pages.

(Continued)

*Primary Examiner* — Hoang Nguyen
(74) *Attorney, Agent, or Firm* — HolzerIPLaw, PC

(57) ABSTRACT

A throttleable exhaust venturi is described herein that generates strong suction pressures at an exhaust outlet by accelerating an incoming ambient fluid stream with the aid of a venturi to high gas velocities and injecting a combustion exhaust stream into the ambient fluid stream at an effective venturi throat. A mixing element downstream of the venturi throat ensures that the mixed fluid stream recovers from a negative static pressure up to local atmospheric pressure. A physical and the effective throat of the venturi are designed to promote mixing and stabilize the ambient fluid flow to ensure that high velocity is achieved and the effective venturi is operable over a variety of combustion exhaust stream mass flow rates.

27 Claims, 23 Drawing Sheets

(56) References Cited

U.S. PATENT DOCUMENTS

| | | | | |
|---|---|---|---|---|
| 8,479,501 | B2 * | 7/2013 | McCarthy, Jr. | 60/301 |
| 2010/0000205 | A1 | 1/2010 | Freese | |
| 2010/0170235 | A1 | 7/2010 | Vannoy | |
| 2011/0011060 | A1 | 1/2011 | McCarthy | |

FOREIGN PATENT DOCUMENTS

| | | | |
|---|---|---|---|
| KR | 20-1997-0003232 | Y1 | 4/1997 |
| KR | 19970003232 | Y1 * | 4/1997 |
| KR | 10-2008-0071839 | A | 8/2008 |
| KR | 20080071839 | A * | 8/2008 |
| KR | 10-2010-0111802 | A | 10/2010 |
| WO | 98-37317 | A1 | 8/1998 |
| WO | 2006061466 | A1 | 6/2006 |
| WO | 2009-099399 | A1 | 8/2009 |
| WO | 2009112888 | A1 | 9/2009 |
| WO | 2012/149461 | A3 | 11/2012 |
| WO | 2012/149462 | A3 | 11/2012 |

OTHER PUBLICATIONS

International Searcing Authority, International Search Report, PCT/US2012/035640, dated Nov. 23, 2012, 5 pages.

International Searching Authority, Written Opinion, PCT/US2012/035640, dated Nov. 23, 2012, 3 pages.

International Searcing Authority, International Search Report, PCT/US2012/035641, dated Nov. 23, 2012, 5 pages.

International Searching Authority, Written Opinion, PCT/US2012/035641, dated Nov. 23, 2012, 5 pages.

European Patent Office, European Search Report, May 26, 2016, 6 pages.

* cited by examiner

| Test Date | Vehicle | Gas Consumed | Miles Traveled | MPG w/out | MPG w/Sonic | Relative Increase | Single/Dual Exhaust | Notes |
|---|---|---|---|---|---|---|---|---|
| | 2006 PRIUS CONTROL | | | 45.0 | | | | EPA HWY MPG Estimate from www.fueleconomy.gov |
| 9-Mar-11 | 2006 Toyota Prius | 1.15 | 73.3 | | 63.7 | 41.6% | Single | Test Track 3 |
| 5-Mar-11 | 2006 Toyota Prius | 1.10 | 73.3 | | 66.6 | 48.1% | Single | Test Track 3 |
| | | | | | | | | |
| | 2007 TOYOTA COROLLA CONTROL | | | 38.0 | | | | EPA HWY MPG Estimate from www.fueleconomy.gov |
| 3-Jan-12 | 2007 Toyota Corolla | 1.35 | 65.0 | | 48.2 | 26.8% | Single | Test Track 2 |
| 29-Dec-11 | 2007 Toyota Corolla | 1.46 | 65.0 | | 44.6 | 17.3% | Single | Test Track 2 |
| 28-Dec-11 | 2007 Toyota Corolla | 1.37 | 65.0 | | 47.4 | 24.9% | Single | Test Track 2 |
| 21-Dec-11 | 2007 Toyota Corolla | 1.43 | 65.0 | | 45.4 | 19.5% | Single | Test Track 2 |
| | | | | | | | | |
| | 2002 FORD SPORT CONTROL | | | 19.0 | | | | EPA HWY MPG Estimate from www.fueleconomy.gov |
| 18-Jan-11 | 2002 Ford Sport Trac | 3.01 | 71.6 | | 23.8 | 25.2% | Single | Test Track 1 |
| | | | | | | | | |
| | | | | 29.0 | | | | EPA HWY MPG Estimate from www.fueleconomy.gov |
| 14-Dec-11 | 1995 318i BMW | | | | 43.0 | 48.3% | Single | Interested Investor undocumented Drive |

FIG. 23

THROTTLEABLE EXHAUST VENTURI

CROSS-REFERENCE TO RELATED APPLICATIONS

The present application claims benefit of priority to U.S. Provisional Patent Application No. 61/480,835, entitled "Throttleable Venturi Exhaust Suction System" and filed on Apr. 29, 2011, which is specifically incorporated by reference herein for all that it discloses or teaches.

BACKGROUND

The fuel-air or other fuel-oxidizer combustion that occurs within internal combustion engines produces a significant amount of heat that is typically dissipated by the walls of the cylinders and through the piston. It is estimated that as much as 50 percent of the available mechanical power that could be generated from an internal combustion engine is lost as heat. Engine cooling creates the mechanism for extracting heat out of the combustion gases, which reduces the amount of mechanical power that can be extracted from these gases. As a result, this dissipation of heat greatly reduces the efficiency of the engine. For example, in a car, it is estimated that about 25% of the available chemical energy from the fuel-oxidizer combustion in the engine is dissipated through the radiator. This is comparable to the fraction of total available power that is converted into useful mechanical power coming out the engine crankshaft. The rest of the energy (e.g., about 50%) is typically lost through the exhaust system (although partial recovery may occur through incorporating turbochargers or similar mechanisms driven by the exhaust). As fuel prices increase, method and systems for recovering some of this lost energy are increasingly desirable.

Previous attempts to incorporate a venturi within an exhaust system for a moving vehicle have failed to produce significant efficiency gains. Further, these prior art designs fail to be throttleable under a variety of combustion engine output states.

SUMMARY

Implementations described and claimed herein address the foregoing problems by providing a throttleable venturi comprising an effective throat with an adjustable size defined by a mass flow ratio of a first separate fluid stream to a second separate fluid stream at the effective throat of the venturi.

Implementations described and claimed herein address the foregoing problems by further providing a method comprising injecting a first fluid stream into a second fluid stream at an effective throat of a throttleable venturi, wherein the effective throat has an adjustable size defined by a mass flow ratio of the second fluid stream to the first fluid stream.

Implementations described and claimed herein address the foregoing problems by further yet providing a throttleable exhaust venturi comprising an ambient fluid path that accelerates an ambient fluid stream to subsonic velocities greater than about Mach 0.3 at an effective venturi throat; and a combustion engine exhaust outlet that discharges a combustion engine exhaust stream into the ambient fluid stream at the effective venturi throat, wherein the effective venturi throat changes size and location within the venturi depending on a mass flow ratio of the ambient fluid stream fluid stream to the combustion engine exhaust stream.

Other implementations are also described and recited herein.

BRIEF DESCRIPTIONS OF THE DRAWINGS

FIG. 23 illustrates example road test trials utilizing a throttleable exhaust venturi based on the design principles disclosed herein on several different vehicles and the corresponding relative improvement in fuel economy.

DETAILED DESCRIPTIONS

Figure 1:
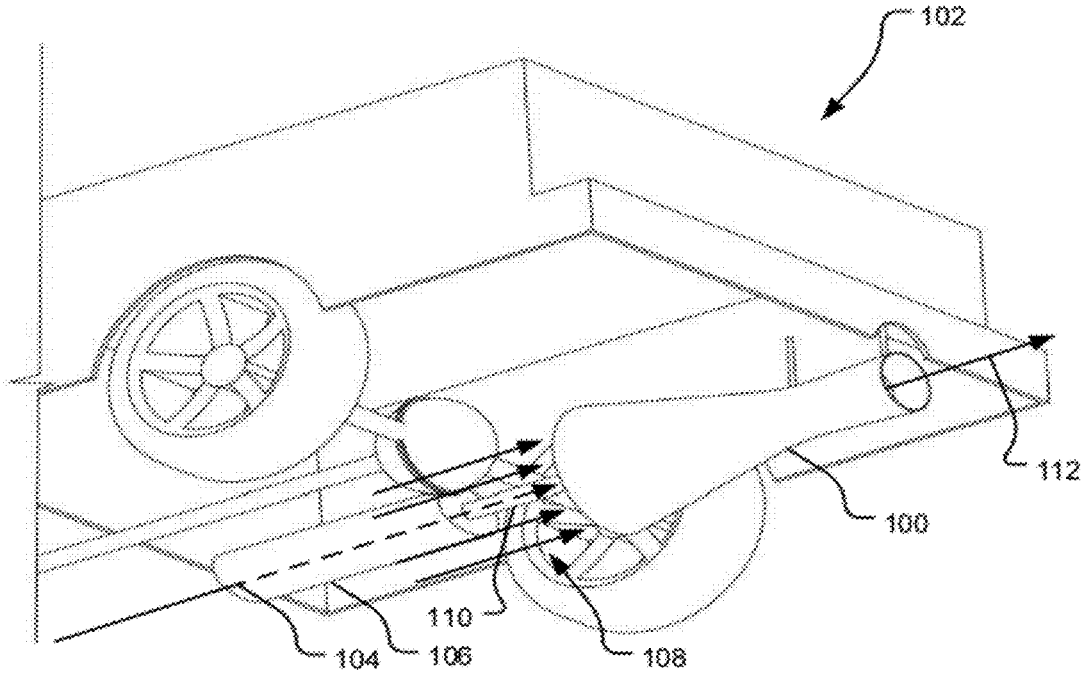
FIG. 1 is a partial perspective view of a vehicle incorporating an example throttleable exhaust venturi.

FIG. 1 is a partial perspective view of a vehicle 102 incorporating an example throttleable exhaust venturi 100. The vehicle 102 is depicted as the rear half of a pick-up truck, the front half of which is omitted for clarity. The vehicle 102 is equipped with a combustion engine (not shown) that produces combustion exhaust gasses that flow through one or more pipes, mufflers and/or catalytic converters (e.g., muffler 106 and inlet pipe 110), as illustrated by arrow 104, and into the throttleable exhaust venturi 100.

Although the presently disclosed technology is described with specificity as used in conjunction with an internal combustion (IC) piston engine, the presently disclosed technology may be used with other types of engines. For example, the presently disclosed technology may be used with a turbine that extracts power from hot combustion gases, a hybrid combination of the IC engine and a turbine (e.g., a turbocharged engine and a turbo-compounded engine), and/or other engines that utilize pressure ratio of fluids inside the engine to convert heat from the fluid gases into useful mechanical work. The presently disclosed technology also applies to other moving or movable vehicles; including aircraft, spacecraft, watercraft (above surface and below surface), ground-based vehicles, and all other vehicles generating mechanical power from gases which are ultimately exhausted from the engine on the vehicle (e.g., vehicles with combustion engines).

When the vehicle 102 is in motion, relatively stationary surrounding ambient fluid (e.g., air or water) is forced into the venturi 100 as illustrated by arrows 108. The presently disclosed technology also applies to stationary combustion engines with an available, moving working fluid (other than the combustion engine exhaust) that may be captured by the venturi 100.

The combustion engine exhaust within the inlet pipe 110 (illustrated by arrow 104) and the surrounding ambient fluid forced into the venturi 100 (illustrated by arrows 110) are combined within the venturi 100 to provide one or more performance enhancing effects on the combustion engine (as discussed in detail below). The combined ambient fluid/engine exhaust then exits the venturi 100 and the vehicle 102, as illustrated by arrow 112.

In one implementation, the venturi 100 receives the ambient fluid and accelerates it to a high subsonic fluid velocity in a compressible fluid regime (e.g., between Mach 0.3 and Mach 1.0) in order to generate large magnitude (e.g., exceeding 1 psig less than a local atmospheric pressure) suction pressures on the engine exhaust. Further, the venturi 100 may achieve and maintain the high velocity and the large magnitude suction on the engine exhaust over a very wide range of combustion engine exhaust flow rates, densities, temperatures, and/or pressures, as well as a very wide range of surrounding ambient fluid velocities (e.g., greater than about 25 miles per hour), pressures (e.g., sea level up to 60,000 feet altitude equivalent), and temperatures (e.g., −100° F. to greater than 200° F.).

Further, because most engines and/or power plants operate over a range of power demands and, in some implementations, vehicle speeds, a particular challenge in the design of such the venturi 100 is ensuring that the venturi 100 operates over a wide range of engine exhaust mass flow rates and input ambient fluid mass flow rates (i.e., the venturi 100 is "throttleable"). Furthermore, the venturi 100 includes a relatively small inlet scoop cross-sectional area that minimizes drag losses to the vehicle 102, which counteract improvements in fuel economy. As a result, the venturi 100 operates over a relatively low ratio of ambient fluid mass flow rates to exhaust mass flow rates (e.g., from about 1:1 to less than 10:1). The low ambient mass flow rates cause the input ambient fluid stream to be particularly susceptible to changes in the exhaust mass flow rate. This complicates achieving "throttleability" of the venturi 100.

The venturi 100 causes large improvements in thermal efficiency for an associated combustion engine (not shown) by applying strong suction at the engine exhaust over a wide range of exhaust mass flow rates. The observed improvements in thermal efficiency may also be obtained using devices other than the venturi 100 that generate strong suction on the engine exhaust (see e.g., FIG. 2). These devices include without limitation mechanical piston pumps, mechanical turbine pumps, and mechanical roots pumps. Further, the improved thermal efficiency may allow the size of the engine's radiator (not shown) to be reduced, or in some implementations, the radiator removed altogether. This may reduce the overall weight and complexity of the vehicle 102. Further, a size reduction or removal of the radiator may yield additional gains in fuel economy by improving the aerodynamic profile of the vehicle 102 and reducing aerodynamic drag.

In one implementation, the venturi 100 may lower exhaust pressure output from the combustion engine, and as a result dramatically increase fuel efficiency of the combustion engine. For example, the venturi 100 may reduce the engine's power requirement to pump out the generated exhaust gases against fluid losses and restrictions that occur in exhaust pipes, catalytic converters, and/or mufflers. In another example, the venturi 100 may reduce mean cylinder pressure inside the combustion engine, which reduces heat loss across the cylinder combustion gas boundary layers into the combustion engine block. This heat loss typically is a significant source of thermal loss from conventional fuel/air combustion engines that do not incorporate the venturi 100. In yet another example, the venturi 100 may provide additional pressure ratio relative to the exhaust outlet and allow additional power generation components (e.g., turbines and turbo-machinery) to be inserted into the exhaust outlet that use this additional pressure ratio to further convert heat from these gases into usable mechanical work.

The presently disclosed technology specifically addresses improvements in converting thermal energy into useable work from high temperature exhaust gases produced from combustion processes. However, the presently disclosed technology may also be applied to other power cycles that use pressurized working fluids that do not utilize combustion to generate high pressures and/or low working fluid densities.

The analysis below describes more specifically how minimizing heat loss from a power system by incorporating the venturi 100 in the vehicle's exhaust provides an opportunity to extract additional fuel efficiency from the vehicle's engine. For a gas-filled piston engine, the differential work, $\delta w_{out,piston}$ extracted from a differential volume change in the cylinder can be described:

$$\delta w_{out,piston} = R_g T_g \left(\frac{dv_g}{v_g}\right), \quad (1)$$

where $R_g$ is the gas constant for the gas interacting with the piston, $T_g$ is the temperature of the gas, $v_g$ is the specific volume of the gas, and $dv_g$ is a differential specific volume change of the piston cylinder volume.

For a turbine operating from an ideal gas, the differential work, $\delta w_{out,turbine}$ extracted from a differential pressure change, $dp_g$, across the turbine rotor/stators can be described:

$$\delta w_{out,turbine} = -\eta_{polytropic} R_g T_{g,t} \left(\frac{dp_{g,t}}{p_{g,t}}\right), \quad (2)$$

where $\eta_{polytropic}$ is the polytropic efficiency of the turbine, $T_{g,t}$ is the stagnation temperature of the gas, $p_g$ is the pressure of the gas, and all other variables have been previously defined.

From Eq. 1 and Eq. 2, for a given power system extracting mechanical power from gas, the specific work derived from this power system increases monotonically the higher the temperature of the gas being used as a working fluid in the power system. Therefore, minimizing heat loss to maintain higher temperature gases in the power system monotonically increases the work output of the power system.

To prevent heat loss from gases moving through a power system the thermal resistance to heat flow from the gases to the external environment is increased. One method for increasing thermal resistance to heat flow from gases in a power system is to utilize high temperature, solid, insulating materials. Another method is to enhance the inherent insulating properties of the power system gases themselves since gases are highly insulating compared to solid materials. The heat transfer coefficient of a gas boundary layer is the inverse of the thermal resistance for heat flow across the boundary layer. Therefore, the higher the heat transfer coefficient, the lower the thermal resistance of the gas boundary layer. For a piston engine, an estimation of the combustion gas boundary layer heat transfer coefficient inside a piston engine is as follows.

$$h_{conv,i}(t) = 21.4 V(t)^{0.6} p_g(t)^{0.8} T_g(t)^{-0.4} (\text{rpm} \cdot L + 1.4)^{0.8}, \quad (3)$$

where $h_{conv,i}(t)$ is the instantaneous gas boundary layer convective heat transfer coefficient, V(t) is the instantaneous volume inside the cylinder as a function of time, $p_g$ (t) is the instantaneous gas pressure inside the cylinder, $T_g(t)$ is the instantaneous gas temperature inside the cylinder, rpm is the average revolutions per minute of a sinusoidal piston cycle, and L is the cylinder stroke.

From Eq. 3, the heat transfer coefficient increases about linearly with cylinder pressure. Therefore, one mechanism for reducing heat loss from a piston engine is to reduce the mean cylinder pressure required to produce a given amount of work. Because improving fuel economy is equivalent to producing more work with a smaller mass of working fluid, as heat loss is decreased, the required mean working fluid density to produce the same amount of net work decreases, which provides further reductions in heat loss. The lower the mean working fluid density, the less fuel/air mix that needs to be injected into the cylinder to produce a given amount of work. By reducing engine exhaust pressure, the insulating effect to heat loss on the combustion gas boundary layer can be achieved, which ultimately improves engine fuel economy.

Further, reductions in exhaust pressure allow the cylinder to be more fully evacuated after a power stroke. For example, in some exemplary piston engines, the residual combusted gases from a previous power stroke that carry over into an intake stroke may make up greater than 15% by volume of the intake volume. For a given power output, these residual gases may require more propellant charge (e.g., fuel-air) to be ingested to make-up for the lost cylinder volume. This additional propellant charge produces a larger peak cylinder pressure near top-dead-center. Near top-dead-center is where the bulk of engine heat loss occurs due to much higher cylinder pressures as compared to elsewhere in the stroke of the engine. Therefore, by placing suction on the exhaust and evacuating these residual gases, lower mean cylinder pressures may be used to generate a given horsepower, which results in lower heat loss from the engine block. Various systems and methods for achieving relatively strong suction pressures on an exhaust system (e.g., via the venturi 100) are described in detail below.

Figure 2:
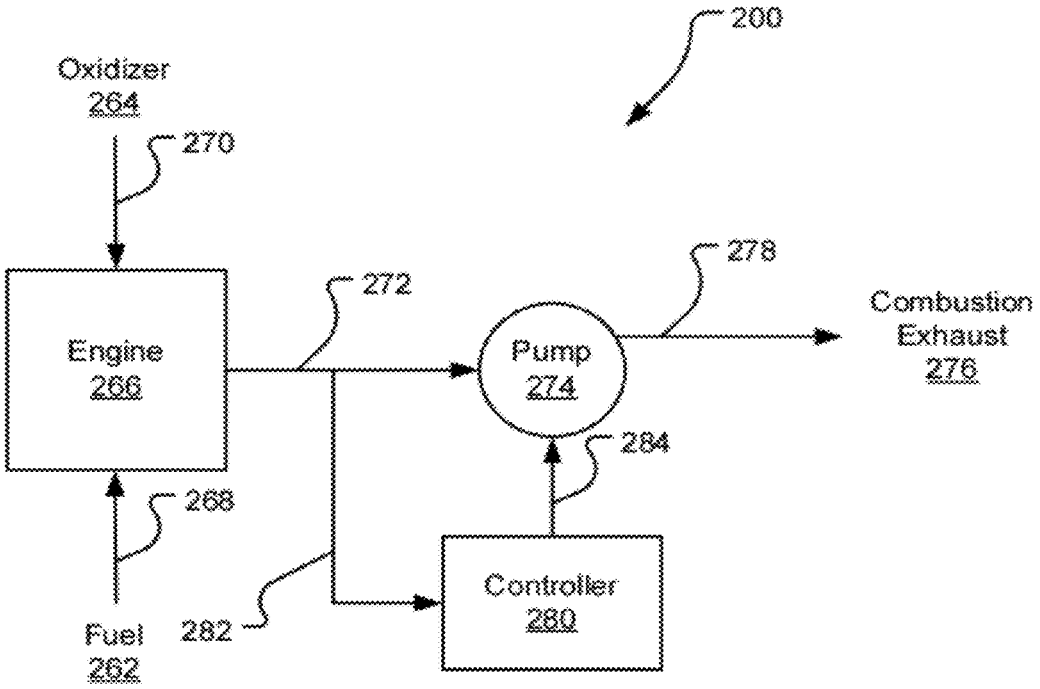
FIG. 2 is a flowchart illustrating a system for providing controllable vacuum pressure on a combustion engine exhaust with a varying exhaust gas output.

FIG. 2 is a flowchart illustrating a system 200 for providing controllable vacuum pressure on a combustion engine exhaust with a varying exhaust gas output. A fuel 262 and an oxidizer 264 are combined within an engine 266 (as illustrated by arrows 268, 270) and combusted to generate work from the engine 266. Exhaust gasses generated from the combustion of the fuel 262 and the oxidizer 264 are exhausted from the engine 266, as illustrated by arrow 272. As discussed above, other types of engines may also utilize the presently disclosed technology.

A vacuum pump 274 provides a suction pressure (i.e., a negative gauge pressure relative to the exhaust gas pressure exiting the engine 266 and/or to the ambient environment) on the exhaust gasses to provide the fuel economy enhancements discussed herein. The vacuum pump 274 is any device capable of inducing a negative pressure on the exhaust gas flow (e.g., a venturi or a mechanically driven pump). A combustion exhaust 276 exits the vacuum pump 274 as illustrated by arrow 278.

In order to attain the "throttleable" characteristic described in detail herein, the vacuum pump 274 may increase its volumetric flow rate to accommodate increased engine exhaust flow rate based on an exhaust gas mass flow rate output from the engine 266, which in turn is based on mechanical power output from the engine 266. The exhaust gas mass flow rate may be detected in real time, for example, using a mass flow rate sensor and fed into a vacuum pump controller 280 as illustrated by arrow 282. The vacuum pump controller 280 controls the volumetric flow rate of the vacuum pump 274 based on the detected exhaust gas mass flow rate as illustrated by arrow 284. In one implementation, the vacuum pump controller 280 varies the rotation speed of a mechanically driven vacuum pump to vary volumetric flow rate for a given suction pressure (e.g., via a variable frequency drive). In another implementation, the vacuum pump controller 280 varies physical characteristics (e.g., a throat size and/or bleed-off features of a venturi) to vary volumetric flow rate. By varying the volumetric flow rate through the pump based on an exhaust gas mass flow rate, the system 200 is "throttleable" over a wide range of engine 266 output conditions. In other implementations, two or more of engine rotational speed, engine torque, engine intake manifold pressure, engine exhaust mass flow rate, engine exhaust temperature, and engine exhaust pressure are used to varying the volumetric flow rate through the pump.

In some engine configurations and loads (e.g. rpm and engine shaft torque), the optimal engine fuel economy may require also varying the suction pressure at the exhaust. In such configurations, the pump controller 280 may sense engine power output (e.g. by monitoring engine rpm and shaft torque) to modify the pump output in order to not only keep up with the varying volumetric flow rate of engine exhaust gases, but also "tune" the suction pressure such that the engine runs under optimal fuel economy for its particular engine loading condition.

Figure 3:
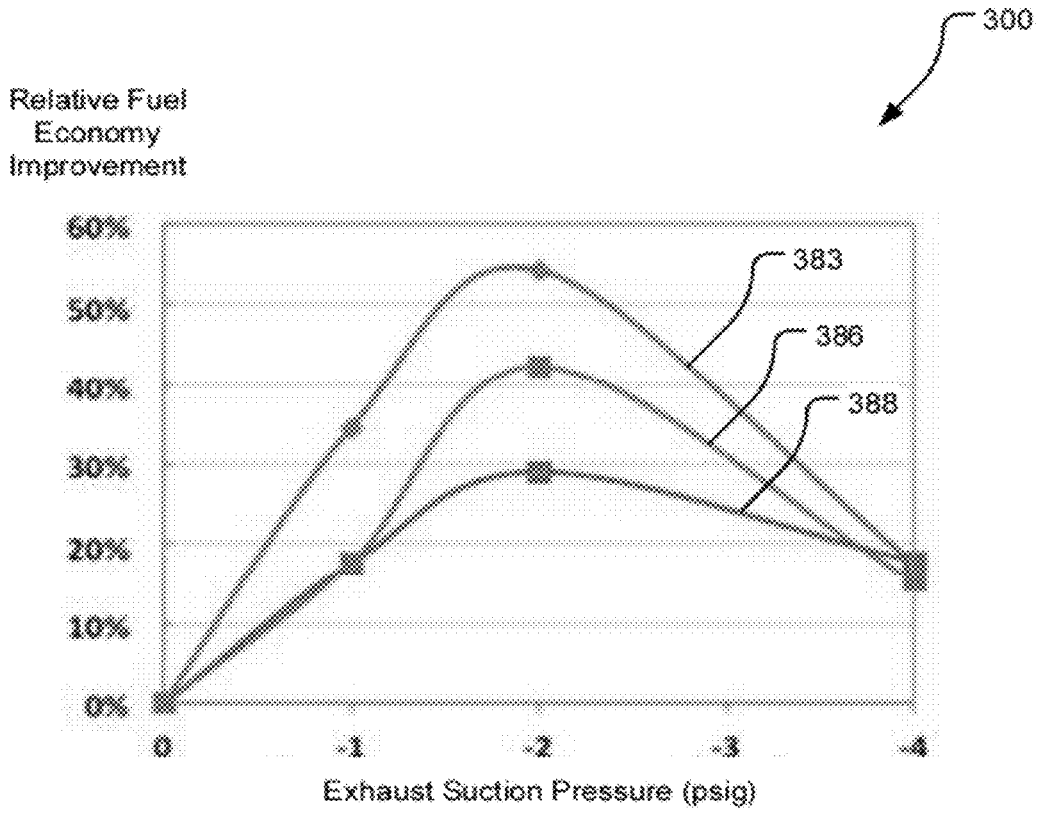
FIG. 3 illustrates a graph of relative improvement in fuel economy for an example 3 cylinder piston combustion engine as a function of exhaust suction pressure and engine load.

FIG. 3 illustrates a graph 300 of relative improvement in fuel economy for an example 3 cylinder piston combustion engine as a function of exhaust suction pressure (psig) and engine load (i.e., torque on the output shaft of the engine). The relative improvement in fuel economy is measured by holding the engine rpm constant at about 2700 rpm and applying three different constant torque settings (with a controlled torque on the engine driveshaft) to the engine. A first torque setting is 25 foot-pounds, illustrated by line 383. A second torque setting is 31 foot-pounds, illustrated by line 386. A third torque setting is 43 foot-pounds, illustrated by line 388.

The three different torque settings are held constant while varying suction pressure on the engine exhaust from about 0 psig to about −4 psig. An optimal suction pressure in this particular engine configuration is about −2 psig. Alternative engine loads, engine rpm, and different engine configurations may shift the optimal suction pressure for achieving maximum relative improvement in engine fuel economy.

In some implementations of the presently disclosed technology, the suction applied exceeds that desired for maximum fuel efficiency improvement (e.g., −5 psig). A controlled vent or flow control valve may be incorporated in the exhaust system to allow additional ambient fluid to enter the exhaust system in order to relieve some of the excess suction pressure. This allows for precise control of the suction pressure produced at the engine exhaust port. Further, the suction may be optimized for maximum fuel economy improvement for a given set of engine loading conditions. Further, a device generating the suction pressure is capable of varying the suction pressure and operating over a wide range of exhaust flow rates to produce the desired suction (i.e., the venturi or other suction generating device is throttleable).

Figure 4:
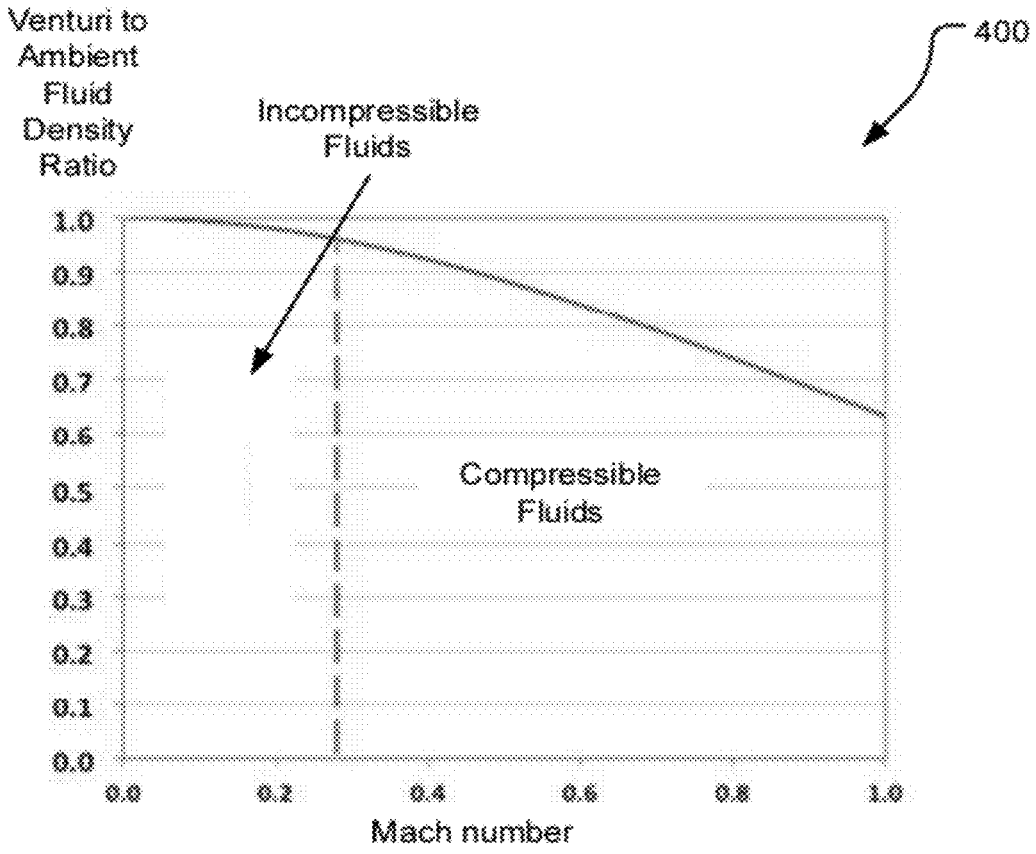
FIG. 4 illustrates a graph of venturi air density ratio as a function of Mach number for an example implementation of the presently disclosed technology.

FIG. 4 illustrates a graph 400 of venturi air density ratio as a function of Mach number for an example implementation of the presently disclosed technology. The graph 400 illustrates that an example fluid (e.g., an ambient fluid stream) behaves essentially as an incompressible fluid (i.e., fluid density is essentially independent of fluid velocity) at less than about Mach 0.3. At above about Mach 0.3, the fluid behaves as a compressible fluid (i.e., fluid density is dependent on fluid velocity). In one implementation, the throttleable venturis disclosed herein accelerate an ambient fluid stream into the compressible fluid regime (e.g., greater than about Mach 0.3). Achieving supersonic (i.e., greater than Mach 1.0) velocities typically requires a pressure upstream of the venturi that is greater than ambient (i.e. a pump may be required to produce this condition). As a result, an example subsonic compressible ambient fluid flow as disclosed herein may flow above Mach 0.3 and below Mach 1.0.

Figure 5:
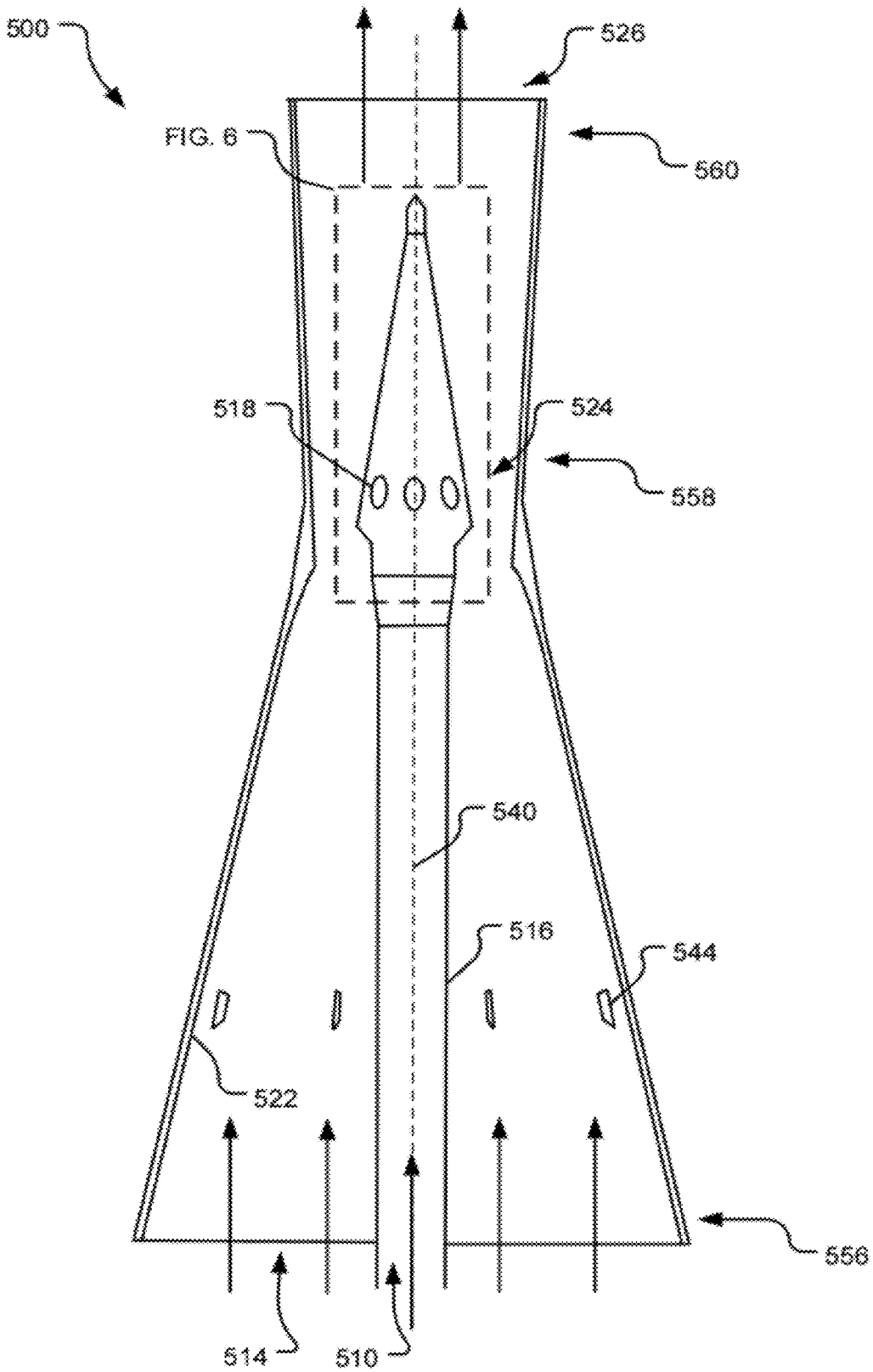
FIG. 5 is a cross sectional view of an example throttleable exhaust venturi.

FIG. 5 is a cross sectional view of an example throttleable exhaust venturi 500. Combustion exhaust gases generated by a combustion engine (not shown) and ambient fluids move through the venturi 500 generally from the bottom to the top of FIG. 5. The throttleable exhaust venturi 500 is a modified venturi tube, which has a varying physical ambient fluid path cross sectional area, which falls to a minimum at a venturi physical throat 524. Without a combustion exhaust stream, the ambient fluid stream is accelerated through the venturi 500 and reaches a peak velocity at the throat 524. The ambient fluid stream is decelerated downstream of the throat 524.

The venturi 500 has an ambient fluid inlet 514 that receives the stream of surrounding ambient fluid and an engine exhaust inlet 510 that receives the exhausted combustion gasses. The exhausted combustion gasses flow within a central tube or pipe 516 within the venturi 500 until the exhausted combustion gasses are introduced into the stream of surrounding ambient fluid at engine exhaust outlets (e.g., outlet 518).

The ambient fluid stream flows through the venturi 500 between the central pipe 516 and an outer housing 522 of the venturi 500. At or near a venturi exhaust throat 524 (i.e., a physical throat), the ambient fluid stream is accelerated to very high velocities (subsonic and compressible) by reducing the cross-sectional area between the central pipe 516 and an outer housing 522 as the ambient fluid stream moves downstream. The venturi throat 524 lies near the smallest cross-sectional area between the central pipe 516 and an outer housing 522 where the exhausted combustion gasses are introduced into the ambient fluid stream and mixed together. The combined stream of ambient fluid and exhausted combustion gasses exit the venturi 500 via a venturi exhaust 526. The combination of the high-velocity ambient fluid stream interacting with the exhausted combustion gasses at or near the throat 524 creates a suction pressure on the engine exhaust outlets of the central pipe 516, which increases the efficiency of the corresponding combustion engine, as discussed in further detail below. This condition at the throat 524 assumes that the conditions downstream of the throat 524 are sufficient to allow the flow exiting into the ambient conditions to recover back up to ambient pressure.

The venturi 500 utilizes a modified compressible fluids Bernoulli principle to accelerate the ambient fluid stream using a constriction in the area in which the ambient fluid flows. This area constriction forces the ambient fluid to accelerate. As the fluid velocity increases, freestream pressure within the ambient fluid drops, which provides the suction pressure on the engine exhaust outlets of the central pipe 516.

In an implementation where the ambient fluid is a gas accelerated to speeds greater than 0.3 times the local speed of sound (i.e., a Mach number equal to or greater than 0.3), the ambient fluid density may drop rather than staying relatively constant. Unlike a about constant density fluid (e.g., a liquid or a lower speed (i.e., less than about Mach 0.3) gas flow, this drop in fluid density allows for rapid increases in fluid velocity through the constriction (e.g., the venturi throat 524) and much higher levels of suction pressure to be produced. These high speeds provide a mechanism for generating very low gauge suction pressures that may not be achievable with other venturis (e.g., venturis that operate at incompressible fluid speeds of less than Mach 0.3 and/or that do not maintain a high Mach number over a wide range of engine exhaust mass flow rates).

In one implementation, the highest speed the ambient fluid may attain within the venturi 500 by moving the venturi 500 through an ambient gas medium (e.g., by attaching the venturi 500 to a moving vehicle as discussed with respect to FIG. 1) is the local speed of sound (i.e., a Mach number equal to 1.0). At vehicle speeds higher than that required to cause sonic velocity ambient fluid flow inside the venturi 500, any additional ambient inlet gases will not be accelerated to velocities greater than the speed of sound within the venturi 300. Instead, any additional ambient inlet fluid will spill over the ambient fluid inlet 514, effectively preventing velocities higher than sonic within the venturi 500. This phenomenon is known as sonic choking and limits the maximum velocity of the ambient fluid flow inside the venturi 500.

With sufficient inlet scoop cross-sectional area, the onset of sonic choking may be designed for relatively low vehicle speeds (e.g. 25 mph) such that at higher vehicle speeds, the mass flow rates of input ambient fluid remain relatively constant through the venturi 500. This feature potentially simplifies one aspect of designing the venturi 500.

In some implementations, various fixed or dynamically adjustable features may be added to the venturi 500 to adjust the velocity of the ambient fluid flow and/or adjust the suction pressure to maintain the optimum suction pressure on the exhaust gas flow. For example, various baffles or exit ports may be added between the outer housing 522 and the central pipe 516. Further, the baffles may be adjusted dynamically or the ports may be dynamically opened or closed depending on the operating conditions of the venturi 500. Still further, the throat 524 may be dynamically adjustable (e.g., via an iris valve) depending on the operating conditions of the venturi 500.

In one implementation, the venturi 500 is axisymmetric about an axis 540. In other implementations, the venturi 500 may have an oval, square, or other non-axisymmetric cross-section about the axis 540. The venturi 500 may also incorporate one or more vortex generators (not shown, see FIG. 12), which add localized angular momentum to the ambient fluid flow to make the ambient fluid flow streamlines more difficult to change their trajectory through influence of the exhausted combustion gasses.

In one implementation, one or more vortex generators (e.g., vortex generator 544) are attached to the inside of the outer housing 522 within the ambient fluid stream, combustion gas stream and/or mixed fluid stream. The vortex generators are small vanes within the ambient fluid stream that are misaligned with the streamlines direction in a manner that causes a vortex-like motion within at least the ambient fluid stream, combustion gas stream and/or mixed fluid stream flowing through the venturi 500. The vortex generators are discussed in more detail below.

In one implementation, the vortex generators are pairs of tabs that protrude less than 0.5 inches into the ambient fluid stream from the outer housing 222 and are less than 1 inch long. For each pair of vortex generators, each tab is "toed-in" relative to its partner so that the pair produces a channel inlet area that is either smaller or larger than its exit area. In many implementations, each pair of mounted vortex generators is alternated so one pair has a larger inlet area relative to outlet area, and the adjacent vortex generator pair reverse this pattern (i.e., has a smaller inlet area relative to outlet area). The "toe-in angle" for each pair relative to the ambient fluid stream flow is commonly less than 20 degrees. Alternative patterns of mounted tabs may be used to generate similar vortex effects.

Figure 6:
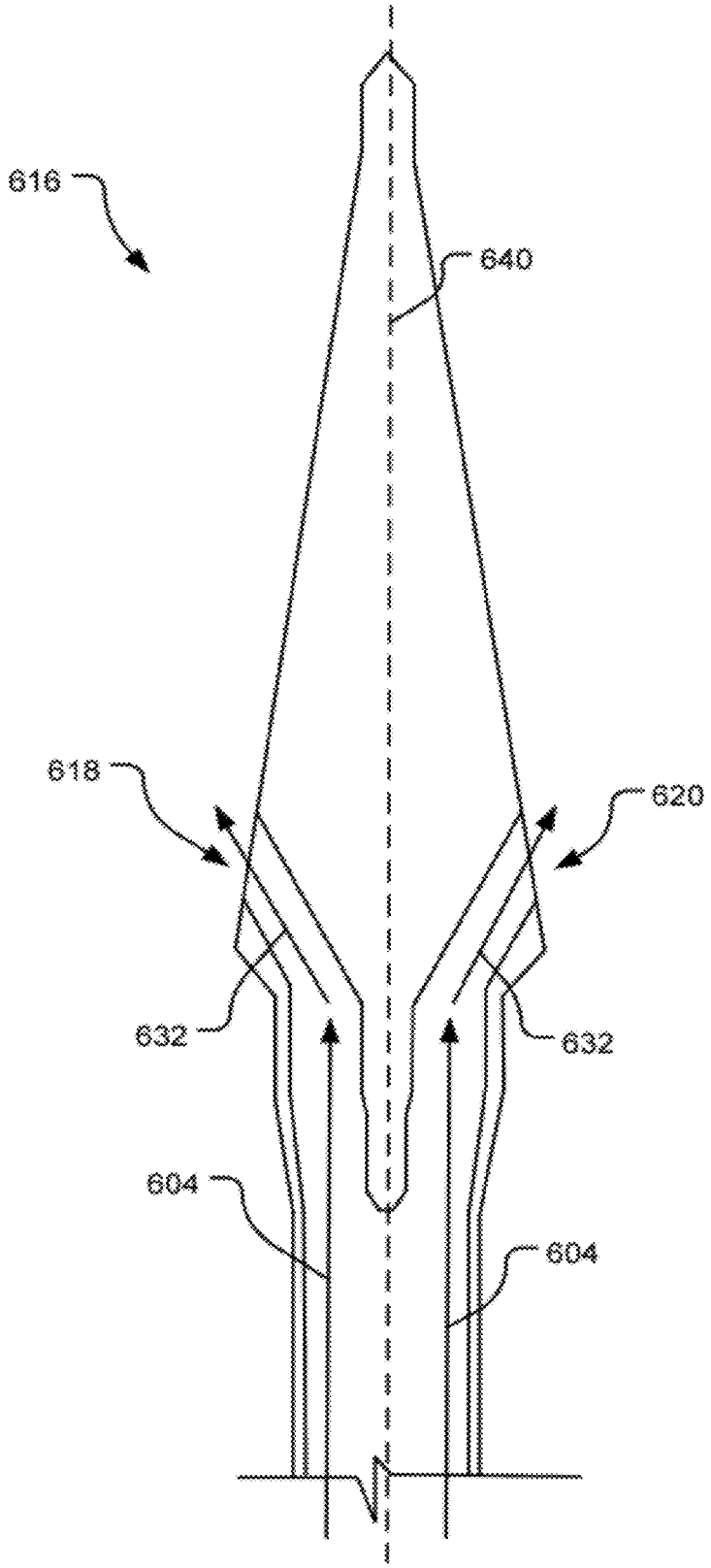
FIG. 6 is a detail view of a central pipe of the example throttleable exhaust venturi of FIG. 5.

FIG. 6 is a detail view of a central pipe 516, 616 of the example throttleable exhaust venturi 200 of FIG. 2. Combustion exhaust gases generated by a combustion engine (not shown) move through the central pipe 616 generally from the bottom to the top of FIG. 6. The cross section of FIG. 6 illustrates a fluid path of exhausted combustion gasses moving through and exiting the central pipe 616. More specifically, the combustion exhaust gasses flow through the central pipe 616 (as illustrated by arrows 604) and exit the central pipe 616 (as illustrated by arrows 632) into a stream of surrounding ambient fluid (not shown) at engine exhaust outlets 618, 620.

In one implementation, the central pipe 616 is axisymmetric about an axis 640. In other implementations, the central pipe 616 may have an oval, square, or other non-axisymmetric cross-section about the axis 640. Further, while two engine exhaust outlets 618, 620 are depicted in FIG. 6, additional engine exhaust outlets may be incorporated on the central pipe 616. In one implementation, two or more engine exhaust outlets are arranged axisymmetrically about the axis 640.

Figure 7:
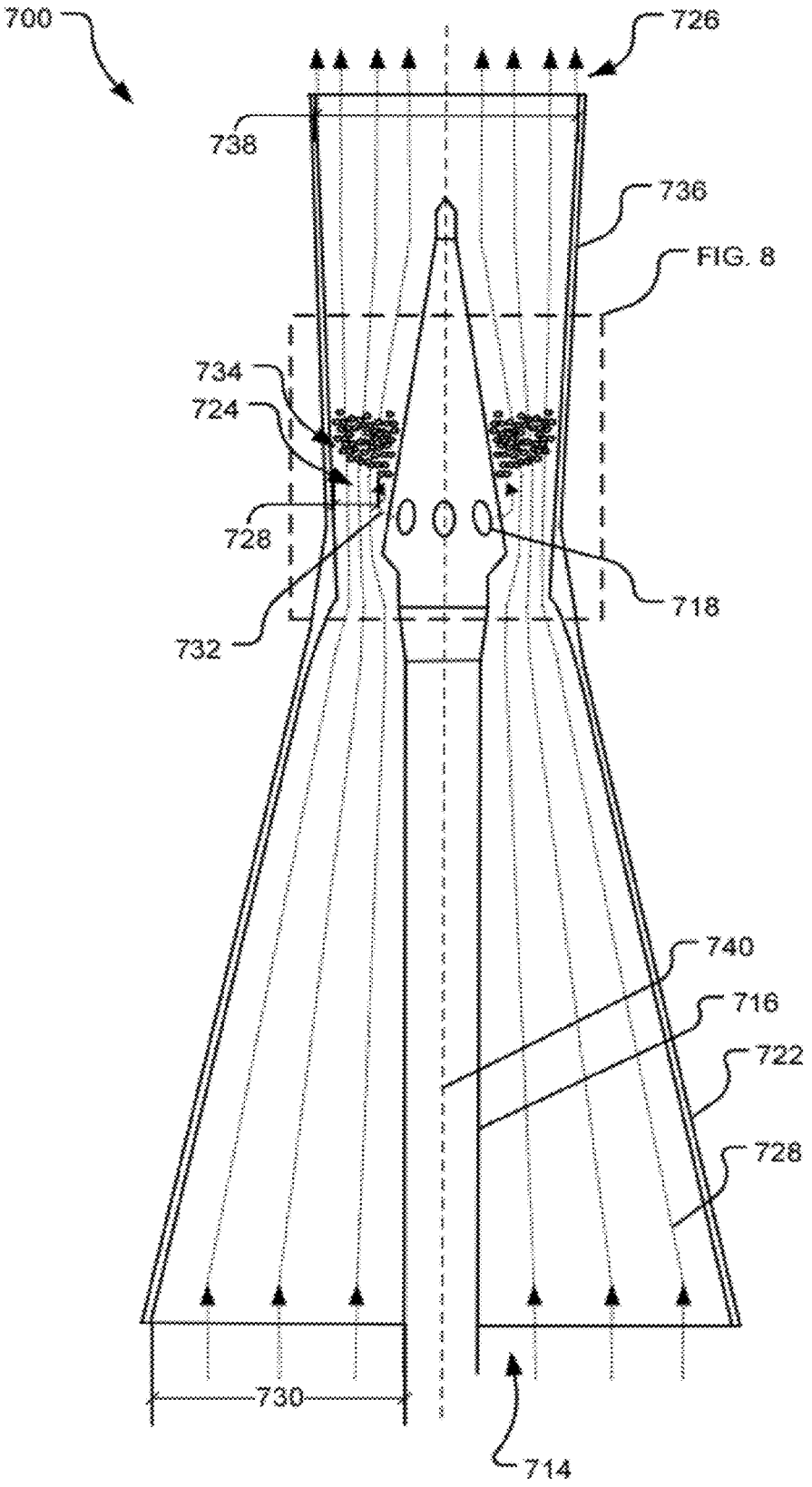
FIG. 7 is a cross-sectional view of an example throttleable exhaust venturi operating in a low exhaust output condition with corresponding fluid flow streamlines.

FIG. 7 is a cross-sectional view of an example throttleable exhaust venturi 700 operating in a low exhaust output condition with corresponding fluid flow streamlines (e.g., streamline 728. The fluid flow streamlines illustrate the approximate bulk fluid motion of ambient fluid and combustion exhaust gasses as they move through the venturi 700. The ambient fluid stream enters the venturi 700 at an ambient fluid inlet 714. A distance between a central pipe 716 containing the combustion exhaust gasses and an outer housing 722 of the venturi 700 at the ambient fluid inlet 714 is referred to herein as an inlet gap 730. The velocity of the ambient fluid stream flowing through the venturi 700 generally increases as the cross-sectional area between the central pipe 716 and the outer housing 722 decreases, generally from the bottom to the top of FIG. 7.

The combustion exhaust gasses travel within the central pipe 716 until being introduced into the ambient fluid stream at exhaust outlets (e.g., outlet 718). Arrows (e.g., arrow 732) illustrate the combustion exhaust gasses exiting the central pipe 716. At or near a physical venturi throat 724 (i.e., where the ambient fluid stream flow cross sectional area reaches a minimum), the ambient fluid stream is accelerated to high velocities (e.g., greater than about Mach 0.3) and the combustion exhaust gasses are introduced into the ambient fluid stream.

Momentum of the combustion exhaust gasses introduced into the ambient fluid stream "pinches" the ambient fluid stream. This alters the cross-sectional area of the ambient gas streamlines at or near the throat 724, thereby creating a smaller area effective throat 728. The exact location and size of the effective throat 728 is dependent on the throat 724, the mass flow rate of the ambient fluid stream, the mass flow rate of the exhaust gas stream, and the position and angle at which the exhaust gas stream is introduced to the ambient fluid stream. At lower exhaust outputs, as illustrated in FIG. 7, the ambient fluid flow effective throat 728 has a relatively large area and extends from the outer housing 722 to close to the engine exhaust outlets.

Downstream of the throat 724, the ambient fluid stream and the combustion exhaust gasses are mixed together at a mixing region 734. The combined stream of surrounding ambient fluid and exhausted combustion products flow through a throttleable expansion nozzle 736 and exit via a venturi exhaust 726. Further, the combined stream of fluids will separate from the inner wall of the expansion nozzle 736 as the combined stream of fluids is projected downstream in the venturi 700. A cross section 738 at which the combined stream of fluids separates from the inner wall of the throttleable expansion nozzle 736 is where the pressure of the combined stream of fluids equalizes with the exterior atmospheric pressure surrounding the venturi 700. Under lower exhaust outputs, as illustrated in FIG. 7, the cross section 738 is relatively close to the exit of the expansion nozzle 736. The dramatically decreased pressure downstream of the throat 724 creates a suction pressure on the exhaust outlets of the central pipe 716 that may increase the fuel efficiency of a corresponding combustion engine (not shown), as explained previously.

In one implementation, the venturi 700 is axisymmetric about axis 740. In other implementations, the venturi 700 may have an oval, square, or other non-axisymmetric cross-section about the axis 740.

Figure 8:
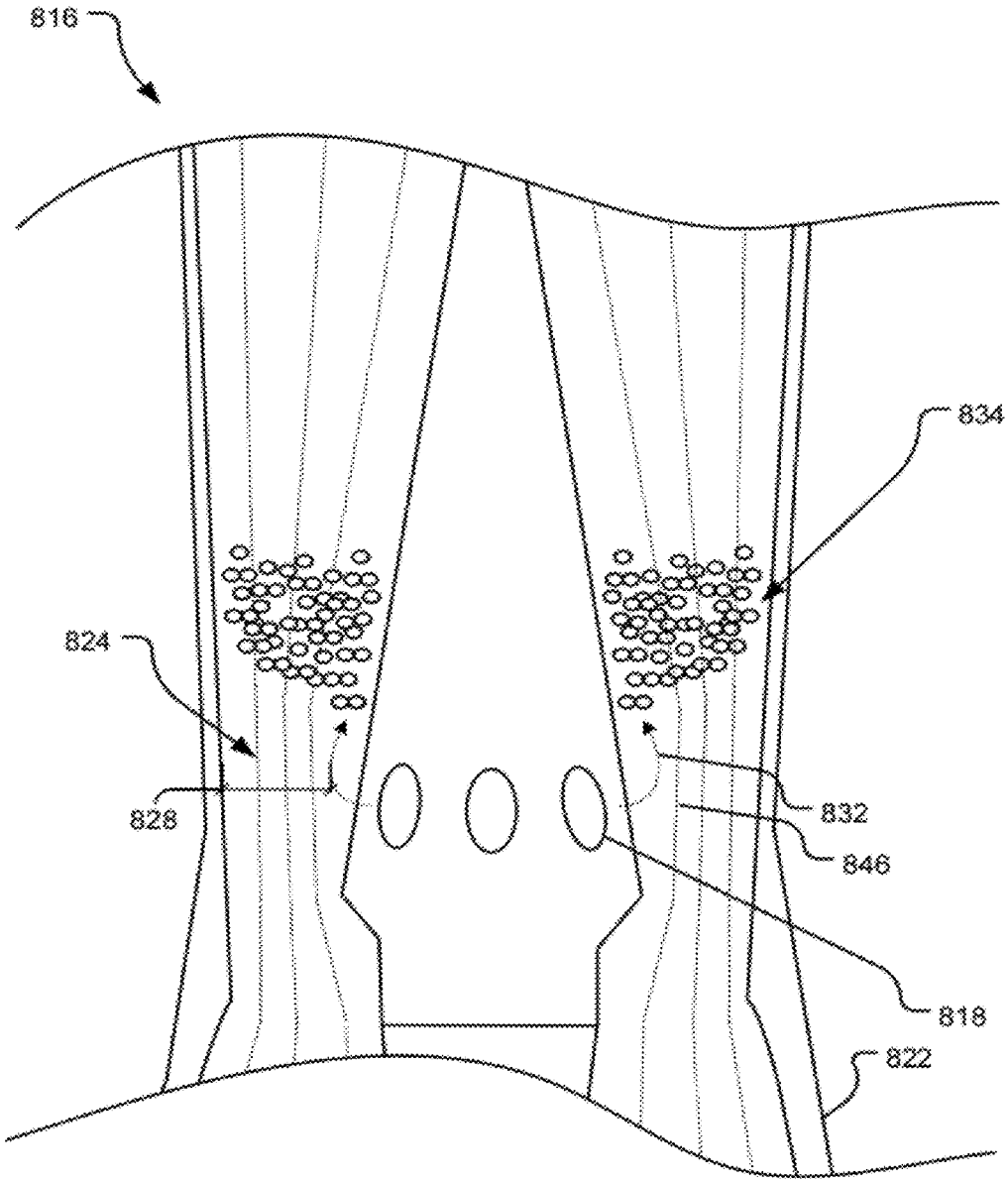
FIG. 8 is a detail view of the central pipe of the example throttleable exhaust venturi of FIG. 7.

FIG. 8 is a detail view of the central pipe 716, 816 of the example throttleable exhaust venturi 700 of FIG. 7. As discussed above with regard to FIG. 7, combustion exhaust gasses travel within the central pipe 816 until being introduced into an ambient fluid stream at exhaust outlets (e.g., outlet 818). Arrows (e.g., arrow 832) illustrate the combustion exhaust gasses exiting the central pipe 816. At or near a venturi throat 824, the ambient fluid stream is accelerated to high velocities (e.g., subsonic compressible fluid flow velocities) and the combustion exhaust gasses are introduced into the ambient fluid stream.

Momentum of the combustion exhaust gasses introduced into the ambient fluid stream "pinches" the ambient fluid stream. This alters the cross-sectional area of ambient gas streamlines (e.g., streamline 846) at or near the throat 824, thereby creating a smaller area and perhaps shifted effective throat 828. At lower exhaust outputs, as illustrated in FIG. 8, the ambient fluid flow effective throat 828 has a relatively large area and extends from outer housing 822 to close to the engine exhaust outlets. The ambient gas streamline 846 is less affected by the combustion exhaust gas boundary layer 832 as compared to the ambient gas streamline 1046 of FIG. 10.

The overall venturi profile is designed such that at or near the throat 824, the cross-sectional area occupied by the ambient fluid streamlines is about constant for a predetermined distance over the exhaust ports. As a result, the ambient fluid stream achieves and maintains a high velocity over the engine exhaust ports. Shortly downstream, the combustion exhaust gases from the central pipe 816 exiting the exhaust ports are mixed (at a mixing region 834) with the combustion exhaust gases exiting the central pipe 816 via the exhaust outlets over a range of combustion exhaust gas output conditions (and associated changes to the ambient gas streamlines. The ambient fluid streamline profile and high subsonic compressible velocity of these streamlines collectively produces strong suction pressure at the exhaust outlets.

Figure 9:
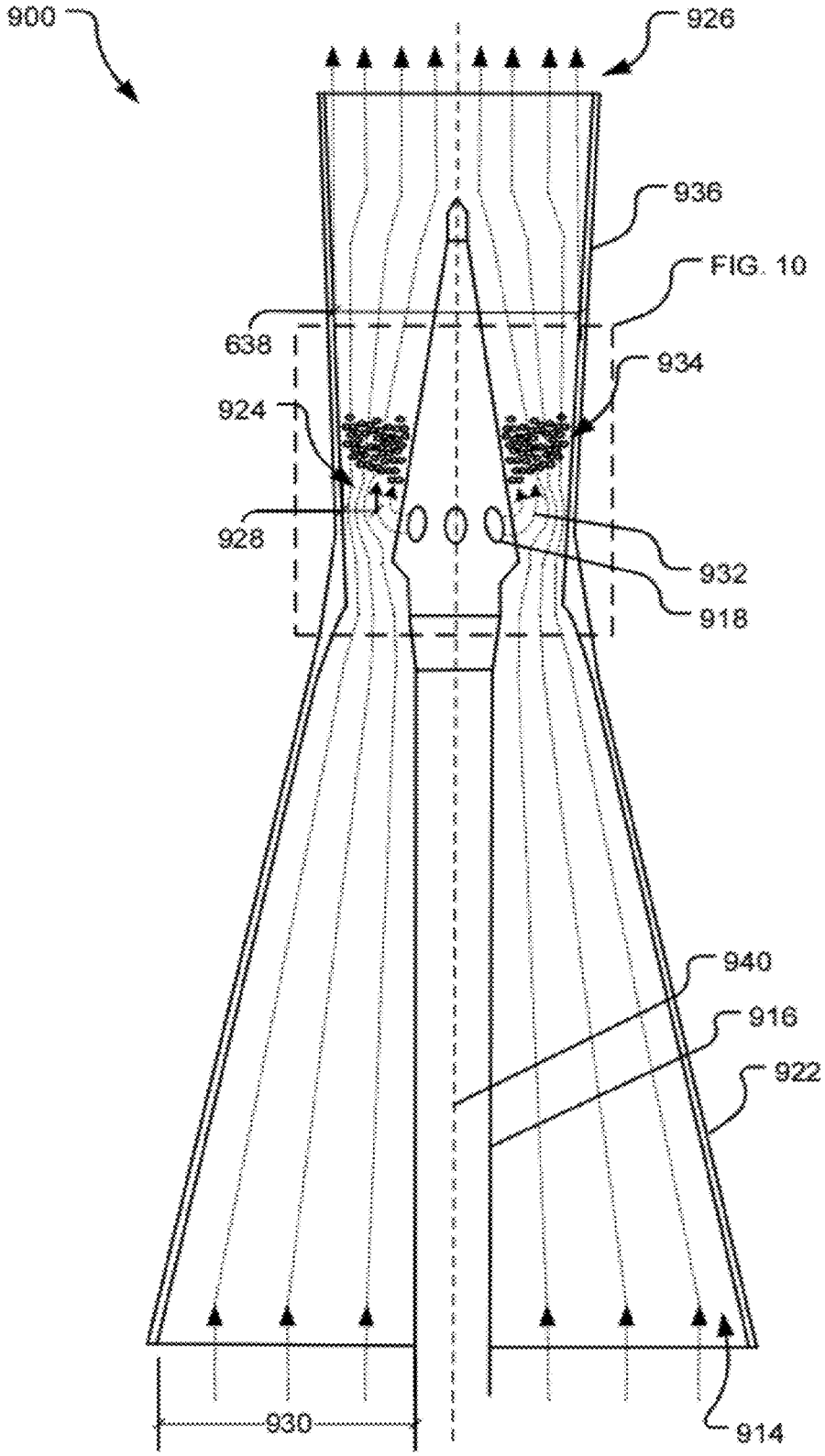
FIG. 9 is a cross-sectional view of an example throttleable exhaust venturi operating in a high exhaust output condition with corresponding fluid flow streamlines.

FIG. 9 is a cross-sectional view of an example throttleable exhaust venturi 900 operating in a high exhaust output condition with corresponding fluid flow streamlines (e.g., streamline 928). The fluid flow streamlines illustrate the approximate bulk fluid motion of ambient fluid and combustion exhaust gasses as they move through the venturi 900. The ambient fluid stream enters the venturi 900 at an ambient fluid inlet 914. A distance between a central pipe 916 containing the combustion exhaust gasses and an outer housing 922 of the venturi 900 at the ambient fluid inlet 914 is referred to herein as an inlet gap 930. The velocity of the ambient fluid stream flowing through the venturi 900 generally increases as the cross-sectional area between the central pipe 916 and the outer housing 922 decreases, generally from the bottom to the top of FIG. 9.

The combustion exhaust gasses travel within the central pipe 916 until being introduced into the ambient fluid stream at exhaust outlets (e.g., outlet 918). Arrows (e.g., arrow 932) illustrate the combustion exhaust gasses exiting the central pipe 916. At or near a venturi throat 924, the ambient fluid stream is accelerated to high velocities and the combustion exhaust gasses are introduced into the ambient fluid stream.

Momentum of the combustion exhaust gasses introduced into the ambient fluid stream "pinches" the ambient fluid stream. This alters the cross-sectional area of the ambient gas streamlines at or near the throat 924, thereby creating a smaller cross-sectional area and perhaps slightly shifting the effective throat 926. At higher exhaust outputs, as illustrated in FIG. 9, a higher momentum of the combustion exhaust gases exiting the central pipe 916 via the engine exhaust outlets forces the ambient fluid flow effective throat 926 to be smaller and potentially slightly further from the engine exhaust outlets (as compared to the throat 724, 824 of FIGS. 7 and 8).

This shift in effective throat cross-sectional area may change the static suction pressure at the exhaust ports. For an approximately constant suction throttleable venturi, a basic design goal is to minimize this shift in location of the effective throat such that the effective throat remains over the exhaust ports even over a wide range of exhaust flow conditions exiting the exhaust ports. In some implementations, the contours in the venturi throat may be designed such that the shift of the effective throat cross-section with varying engine exhaust output may be tuned for a particular engine and its output conditions in order to further optimize the level of suction that is produced for optimizing fuel economy of a particular engine without requiring a separate active controller.

Reducing the effective throat 926 size reduces the mass flow rate of the ambient fluid stream (i.e., the mass flow rate of the ambient fluid stream decreases with higher combustion exhaust gas output). The inlet gap 930 (which corresponds to an inlet area) of the venturi exhaust 900 is designed for both the extreme example states of FIGS. 7 and 8 (large effective throat 726, 826 and low combustion exhaust gas output) and FIGS. 9 and 10 (small effective throat 926, 1026 and high combustion exhaust gas output).

Downstream of the throat 924, the ambient fluid stream and the combustion exhaust gasses are mixed together at a mixing region 934. The combined stream of surrounding ambient fluid and exhausted combustion products flow through a throttleable expansion nozzle 936 and exit via a venturi exhaust 926. Further, the combined stream of fluids will separate from the inner wall of the expansion nozzle 936 as the combined stream of fluids is projected downstream in the venturi 900. A cross section 938 at which the combined stream of fluids separates from the inner wall of the throttleable expansion nozzle 936 is approximately where the pressure of the combined stream of fluids equalizes with the exterior atmospheric pressure surrounding the venturi 900.

At higher exhaust outputs, as illustrated in FIG. 9, the cross section 938 moves away from the exit of the expansion nozzle 936 and closer to the throat 924 (compare to cross section 738 of FIG. 7). This effect is due to the fact that the exhaust flow "pinches" the venturi ambient fluid stream and decreases the mass flow rate of input ambient fluid, thereby changing the total mixed mass flow rate exiting the venturi 900. The cross-sectional area is defined by conservation of mass, momentum, and energy considerations for the two fluid streams. The diverging nozzle section 936 allows for some pass "self-compensation" of mixed fluid stream exit area, which is one aspect important for the design of the throttleable venturi 900. The dramatically decreased pressure downstream of the throat 924 creates a suction pressure on the exhaust outlets of the central pipe 916 that may increase the fuel efficiency of a corresponding combustion engine (not shown), as explained previously.

In one implementation, the venturi 900 is axisymmetric about axis 940. In other implementations, the venturi 900 may have an oval, square, or other non-axisymmetric cross-section about the axis 940.

Figure 10:
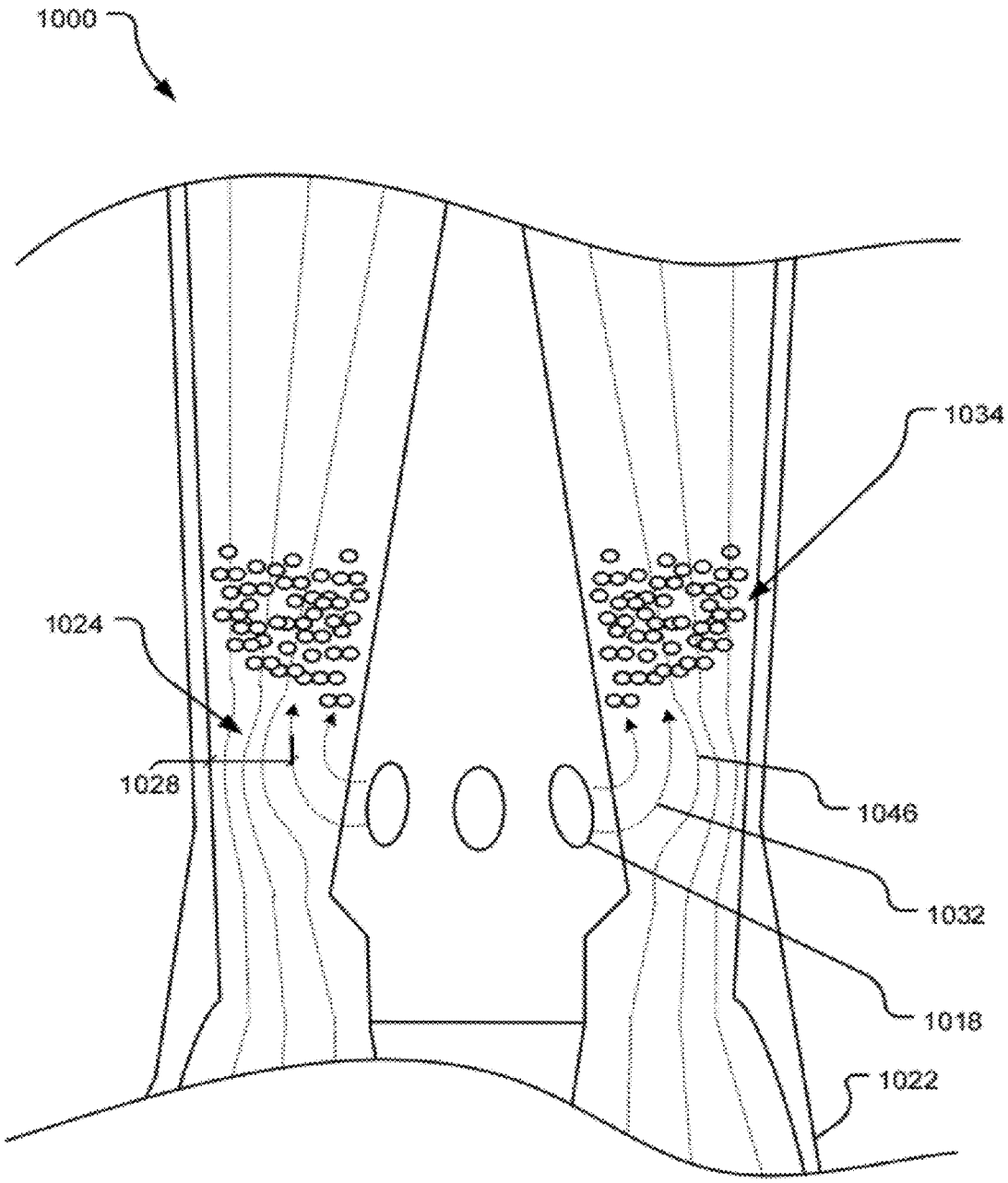
FIG. 10 is a detail view of the central pipe of the throttleable exhaust venturi of FIG. 9.

FIG. 10 is a detail view of the central pipe 916, 1016 of the throttleable exhaust venturi 900 of FIG. 9. As discussed above with regard to FIG. 9, combustion exhaust gasses travel within the central pipe 1016 until being introduced into an ambient fluid stream at exhaust outlets (e.g., outlet 1018). Arrows (e.g., arrow 1032) illustrate the combustion exhaust gasses exiting the central pipe 1016. At or near a venturi throat 1024, the ambient fluid stream is accelerated to high velocities (e.g., subsonic compressible fluid flow velocities) and the combustion exhaust gasses are introduced into the ambient fluid stream.

Momentum of the combustion exhaust gasses introduced into the ambient fluid stream "pinches" the ambient fluid stream. This alters the cross-sectional area of ambient gas streamlines (e.g., streamline 1046) at or near the throat 1024, thereby creating a smaller cross sectional area and perhaps shifted effective throat 1028. At higher exhaust outputs, as illustrated in FIG. 10, a higher momentum of the combustion exhaust gases exiting the central pipe 1016 via the engine exhaust outlets forces the ambient fluid flow effective throat 1026 to be smaller and further from the engine exhaust outlets (as compared to the throat 724, 824 of FIGS. 7 and 8). As such, the ambient gas streamline 1046 is more affected by the combustion exhaust gas boundary layer 1032 as compared to the ambient gas streamline 846 of FIG. 8.

The overall venturi profile is designed such that at or near the throat 1024, the cross-sectional area occupied by the ambient fluid streamlines is about constant over the exhaust ports. As a result, the ambient fluid stream achieves and maintains a high velocity as it is mixed (at a mixing region 1034) with the combustion exhaust gases exiting the central pipe 1016 via the exhaust outlets over a range of combustion exhaust gas output conditions (and associated changes to the ambient gas streamlines). The ambient fluid streamline profile and high velocity of the streamlines collectively produces strong suction pressure at the exhaust outlets.

Figure 11:
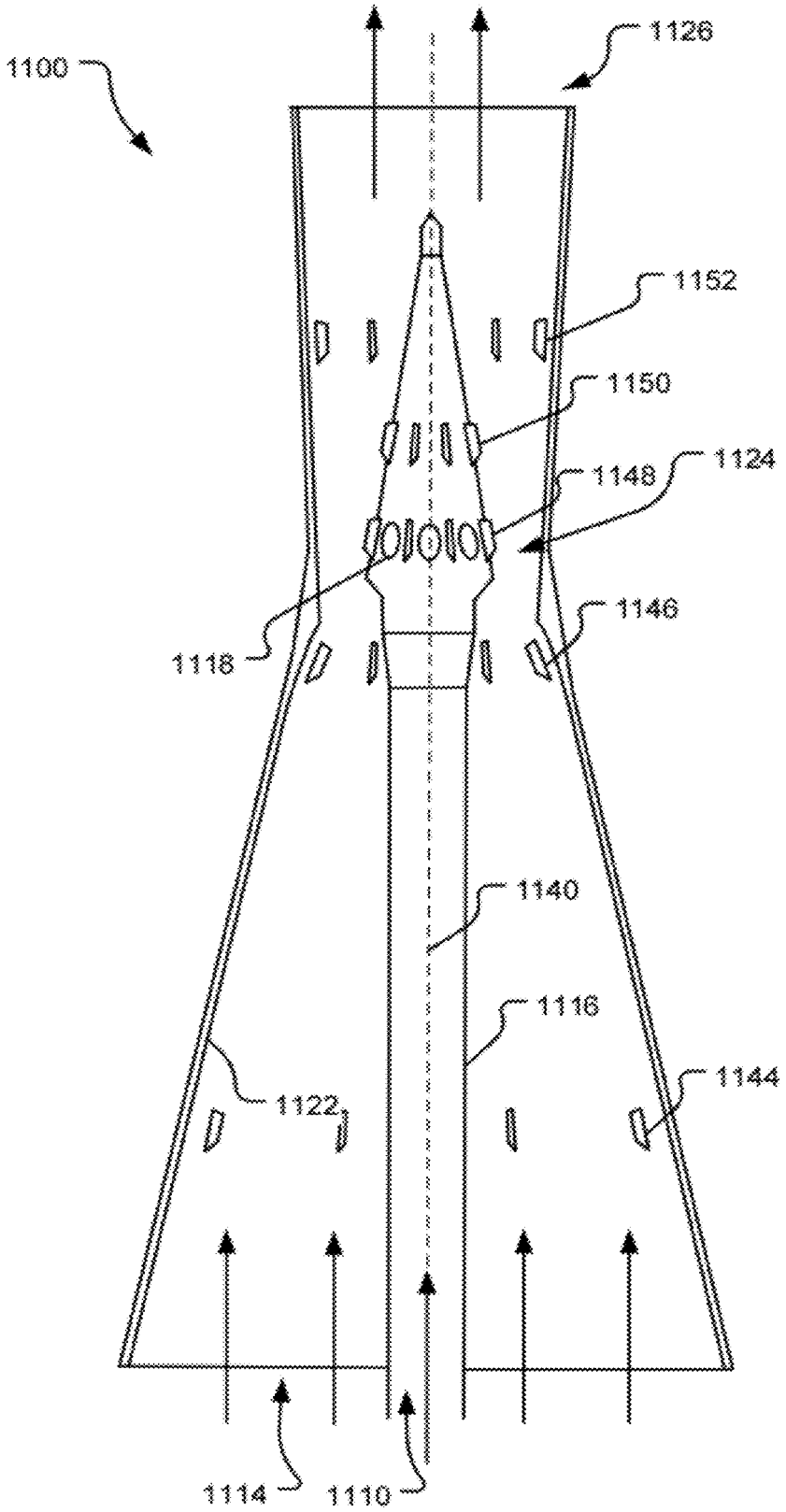
FIG. 11 is a cross sectional view of an example throttleable exhaust venturi incorporating vortex generators.

FIG. 11 is a cross sectional view of an example throttleable exhaust venturi 1100 incorporating vortex generators (e.g., generators 1144, 1146, 1148, 1150, 1152). Combustion exhaust gases generated by a combustion engine (not shown) and ambient fluids move through the venturi 1100 generally from the bottom to the top of FIG. 11. The venturi 1100 has an ambient fluid inlet 1114 that receives a stream of surrounding ambient fluid and an engine exhaust inlet 1110 that receives the exhausted combustion gasses. The exhausted combustion gasses flow within a central tube 1116 within the venturi 1100 until the exhausted combustion gasses are introduced into the stream of surrounding ambient fluid at engine exhaust outlets (e.g., outlet 1118).

The ambient fluid stream flows through the venturi 1100 between the central pipe 1116 and an outer housing 1122 of the venturi 1100. At or near a venturi exhaust throat 1124, the ambient fluid stream is accelerated to high velocities (e.g., subsonic compressible fluid flow velocities) by reducing the cross-sectional area between the central pipe 1116 and an outer housing 1122 as the ambient fluid stream moves downstream. The venturi throat 1124 lays near the smallest cross-sectional area between the central pipe 216 and an outer housing 1122 where the exhausted combustion gasses are introduced into the ambient fluid stream and mixed together. The combined stream of ambient fluid and combustion exhaust gasses exit the venturi 1100 via a venturi exhaust 1126. The combination of the high velocity ambient fluid stream interacting with the combustion exhaust gasses at or near the throat 1124 creates a suction pressure on the exhaust outlets of the central pipe 1116, which increases the efficiency of the corresponding combustion engine.

The venturi 1100 may be designed to operate under a variety of throttle conditions of the combustion engine, and thus a variety of combustion exhaust gas mass flow rates. When the venturi 1100 is operating using a high combustion exhaust gas mass flow range, the ambient fluid stream (due to the lower ratio of mass flow rate of ambient fluid relative to exhaust gas) may become particularly susceptible to the fluid stream effects of the engine exhaust stream due to the exhaust gas momentum making up a more significant fraction of the ambient fluid momentum. While the venturi 1100 may work at one combustion engine operating point, increasing or decreasing the engine output, and thus the combustion exhaust gas mass flow rate may alter the location of an effective venturi throat and reduce the available suction pressure on the exhaust outlets. In these low combustion exhaust gas mass flow ranges, the vortex generators or other mechanisms may minimize the fluid effect of the high combustion exhaust gas stream on the ambient fluid stream by adding vorticity to the ambient fluid stream flow which makes the ambient fluid stream more difficult to manipulate by the exhaust gases exiting the ports.

In one implementation, one or more vortex generators (e.g., vortex generators 1144, 1146) are attached to the inside of the outer housing 1122 within the ambient fluid stream, upstream of the throat 1124. The vortex generators are small vanes within the ambient fluid stream that are misaligned with the streamlines direction in a manner that causes a vortex-like motion within at least the ambient fluid flowing through the venturi 1100.

The vortex generators add localized angular momentum to the ambient fluid stream and effectively "stiffen" the ambient fluid streamlines so that they are less easily altered or compressed by external pressures or forces. This additional localized angular momentum may resist the influence of the combustion exhaust gas at the throat 1124 and allow the combustion engine to be operated over a greater range of throttle conditions (and thus combustion exhaust gas mass flow rates) with little to no change in the suction pressure in the exhaust outlets. Furthermore, the associated vorticity (or the magnitude of the spiral motion of the fluid stream(s) with closed streamlines) may enhance gas stream mixing downstream of the throat 1124.

In another implementation, one or more vortex generators (e.g., vortex generators 1148) are attached to the inside of the outer housing 1122 within the ambient fluid stream, at or near the throat 1124. In yet another implementation, one or more vortex generators (e.g., vortex generators 1150, 1152) are attached to the inside of the outer housing 1122 within the ambient fluid stream, downstream of the throat 1124.

As the ambient fluid streamlines compresses, rotational velocity of vortices caused by the vortex generators placed at, near, upstream, or downstream of the throat 1124 may increase providing sufficient vorticity to "stiffen" the ambient fluid stream and thereby render the ambient fluid stream sufficiently insensitive to combustion exhaust gas mass flow rate changes. Furthermore, the vorticity may enhance gas stream mixing of the combined stream of ambient fluid and combustion exhaust gasses downstream of the throat 1124.

The arrangement of vortex generators of FIG. 11 illustrates five distinct groupings of vortex generators, a first grouping of vortex generators (e.g., vortex generator 1144) well upstream of the throat 1124, a second grouping of vortex generators (e.g., vortex generator 1146) slightly upstream of the throat 1124, a third grouping of vortex generators (e.g., vortex generator 1148) at the throat 1124, a fourth grouping of vortex generators (e.g., vortex generator 1150) slightly downstream of the throat 1124, and a fifth grouping of vortex generators (e.g., vortex generator 1152) well downstream of the throat 1124.

While each grouping of vortex generators illustrated in FIG. 11 includes 4 depicted vortex generators, another 4 vortex generators may be included in each grouping that are not shown in FIG. 11. Further, other quantities of individual vortex generators in each grouping are contemplated. Still further, greater or fewer groupings of vortex generators may be used in an individual throttleable exhaust venturi application. In one implementation, the venturi 1100 is axisymmetric about an axis 1140. In other implementations, the venturi 1100 may have an oval, square, or other non-axisymmetric cross-section about the axis 1140.

Figure 12:
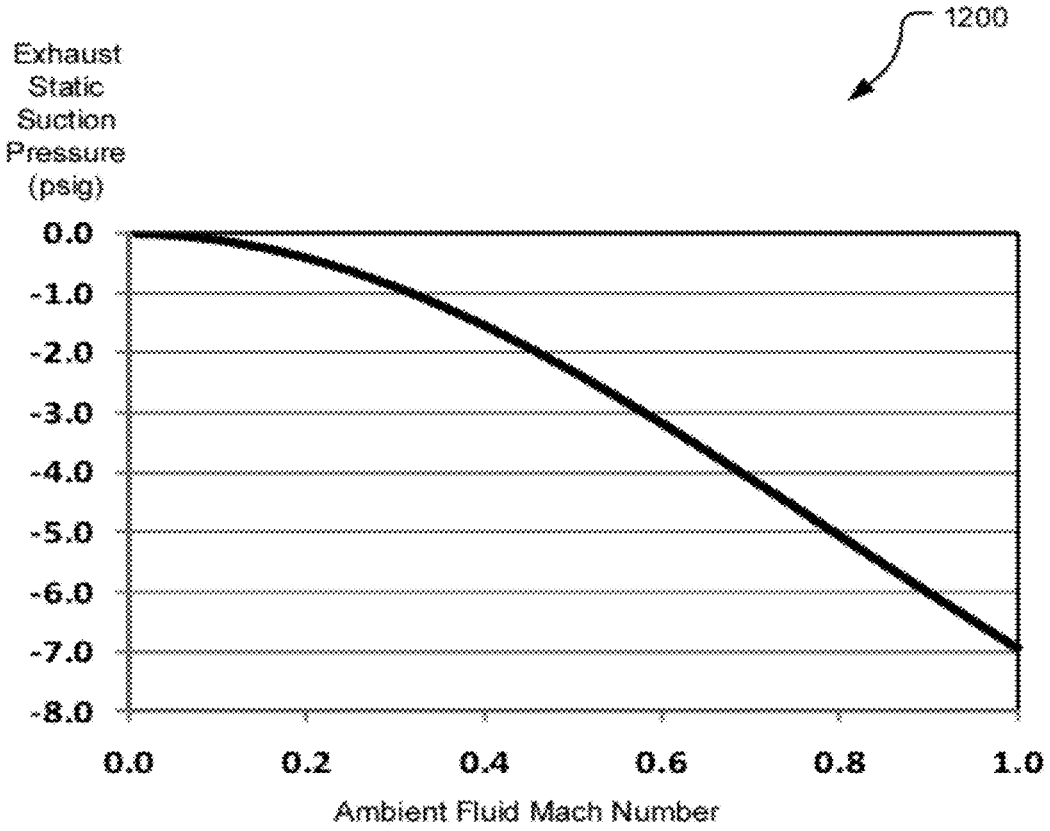
FIG. 12 illustrates a graph of maximum exhaust static suction pressure as a function of ambient fluid streamline Mach number at a venturi throat of an example throttleable exhaust venturi.

FIG. 12 illustrates a graph 1200 of exhaust static suction pressure as a function of ambient fluid streamline Mach number at a venturi throat of an example throttleable exhaust venturi. Graph 1200 illustrates the maximum static suction pressure the ambient fluid streamline can achieve as a function of the ambient fluid speed as derived from the gas dynamics relationship for isentropic flow along a streamline:

$$P_{static} = P_{stagnation}\left(1 + \frac{(\gamma - 1)}{2}M^2\right)^{\frac{\gamma}{(1-\gamma)}}, \tag{4}$$

where $P_{static}$ is the static pressure of the ambient fluid streamline, M is the speed of the ambient fluid streamline expressed as a Mach number, $P_{stagnation}$ is the stagnation pressure of the ambient fluid, and $\gamma$ is the specific heat ratio of the ambient fluid. In practice, fluid friction with solid surfaces, heat transfer from the ambient fluid, internal fluid momentum losses due to mixing and fluid shearing between the higher Mach ambient fluid stream and a lower Mach combustion exhaust stream, etc. will degrade the performance of this idealized curve. Due to the non-zero velocity of the combustion exhaust stream, the engine exhaust stagnation pressure ultimately experienced upstream may be higher than the ambient fluid static stagnation pressure at the venturi throat (see e.g., FIG. 13).

Figure 13:
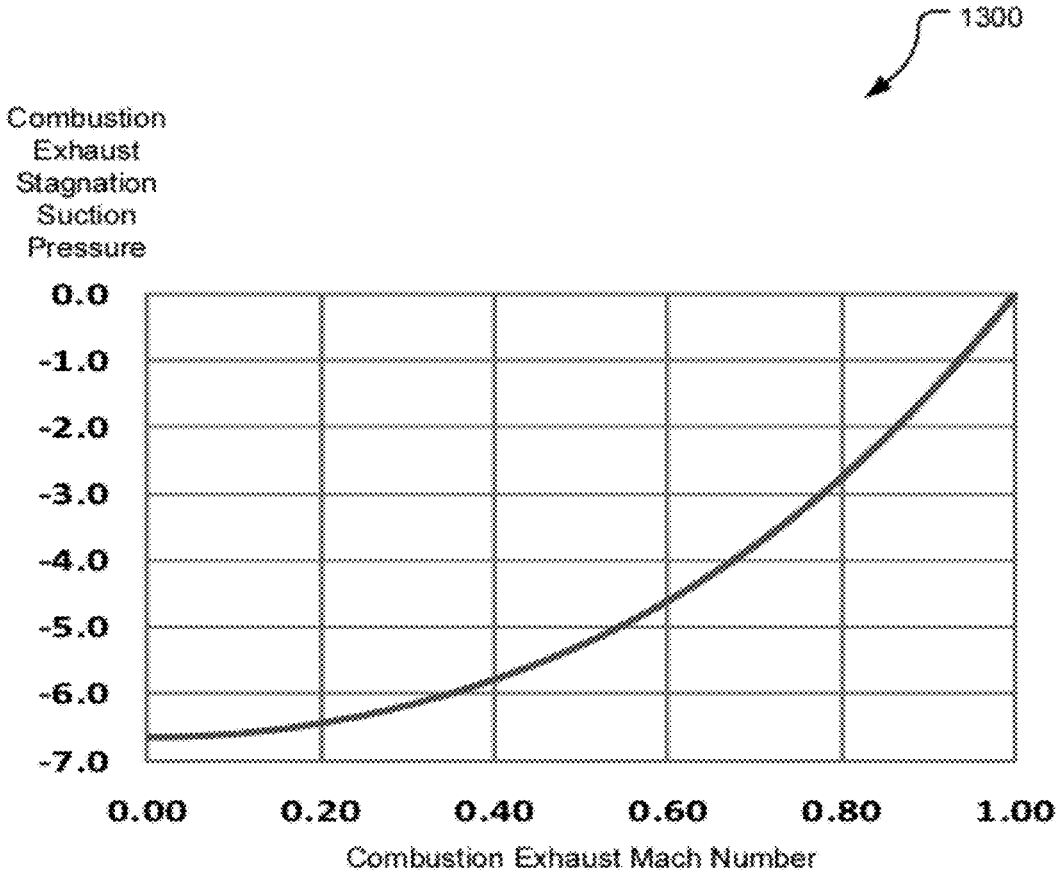
FIG. 13 illustrates a graph of combustion exhaust gas stagnation suction pressure as a function of combustion exhaust Mach number in an example throttleable exhaust venturi.

FIG. 13 illustrates a graph 1300 of combustion exhaust gas stagnation suction pressure as a function of combustion exhaust Mach number in an example throttleable exhaust venturi. Graph 1300 assumes sonic ambient fluid streamlines interacting at a combustion exhaust output. Graph 1300 illustrates the objective to design the combustion exhaust outlet gas velocity to be slow (i.e., a low Mach number) in order to achieve low stagnation pressure (i.e., more negative gauge stagnation suction pressure) in the engine exhaust system.

Figure 14:
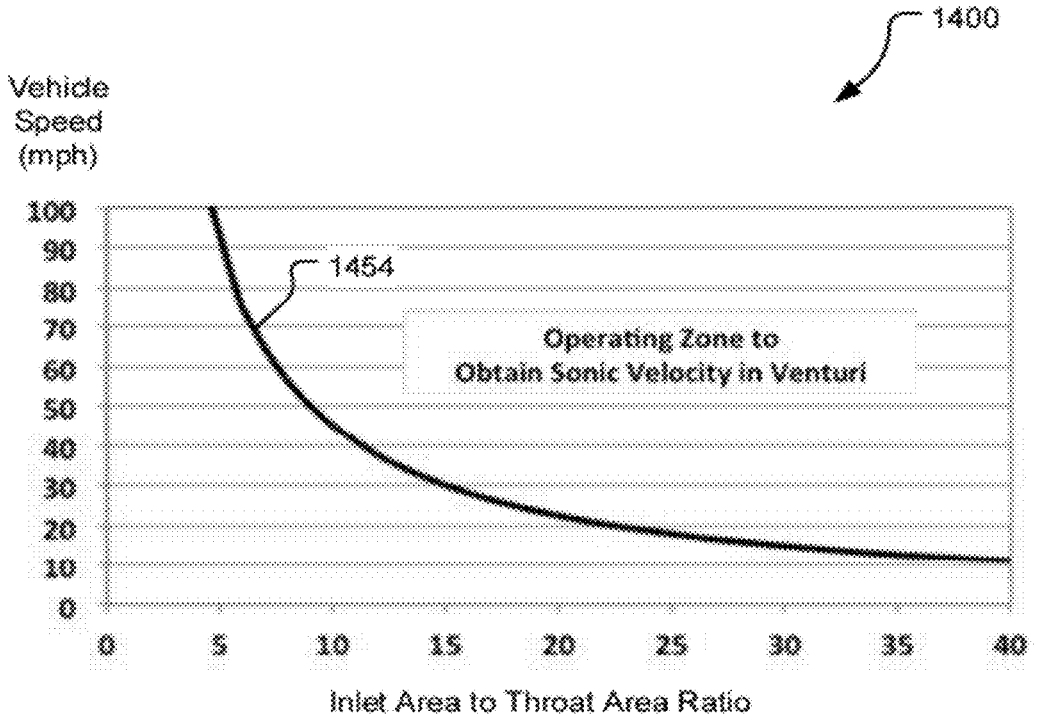
FIG. 14 illustrates a graph of an operating zone within which ambient fluid streamlines obtain sonic velocity in a venturi throat of an example throttleable exhaust venturi.

FIG. 14 illustrates a graph 1400 of an operating zone within which ambient fluid streamlines obtain sonic velocity in a venturi throat of an example throttleable exhaust venturi. The operating zone lies above a boundary line 1454 and is a function of the ratio of venturi inlet area to effective throat area and inlet air speed (expressed as vehicle speed in miles per hour). Staying above the boundary line 1454 ensures the ambient fluid streamline achieves sonic velocity within the example throttleable exhaust venturi. Alternative designs may not precisely meet this ratio if venturi throat velocities less than sonic velocity are sufficient for generating the required suction pressure.

In practice, variations in an effective throat gap will occur due to changing combusted exhaust gas output (see e.g., effective throat 828 of FIG. 8 as compared to effective throat 1028 of FIG. 10). To ensure that a high velocity of the ambient fluid is attained over all exhaust output conditions, the maximum effective throat gap should be used in sizing the ingested ambient fluid inlet area (see e.g., inlet gap 730 of FIG. 7). In practice, velocities slightly lower than the operating boundary identified above can be used to achieve high velocities in the venturi, but the sonic condition and benefit of strong suction associated with the near sonic velocity condition is rapidly lost.

Figure 15:
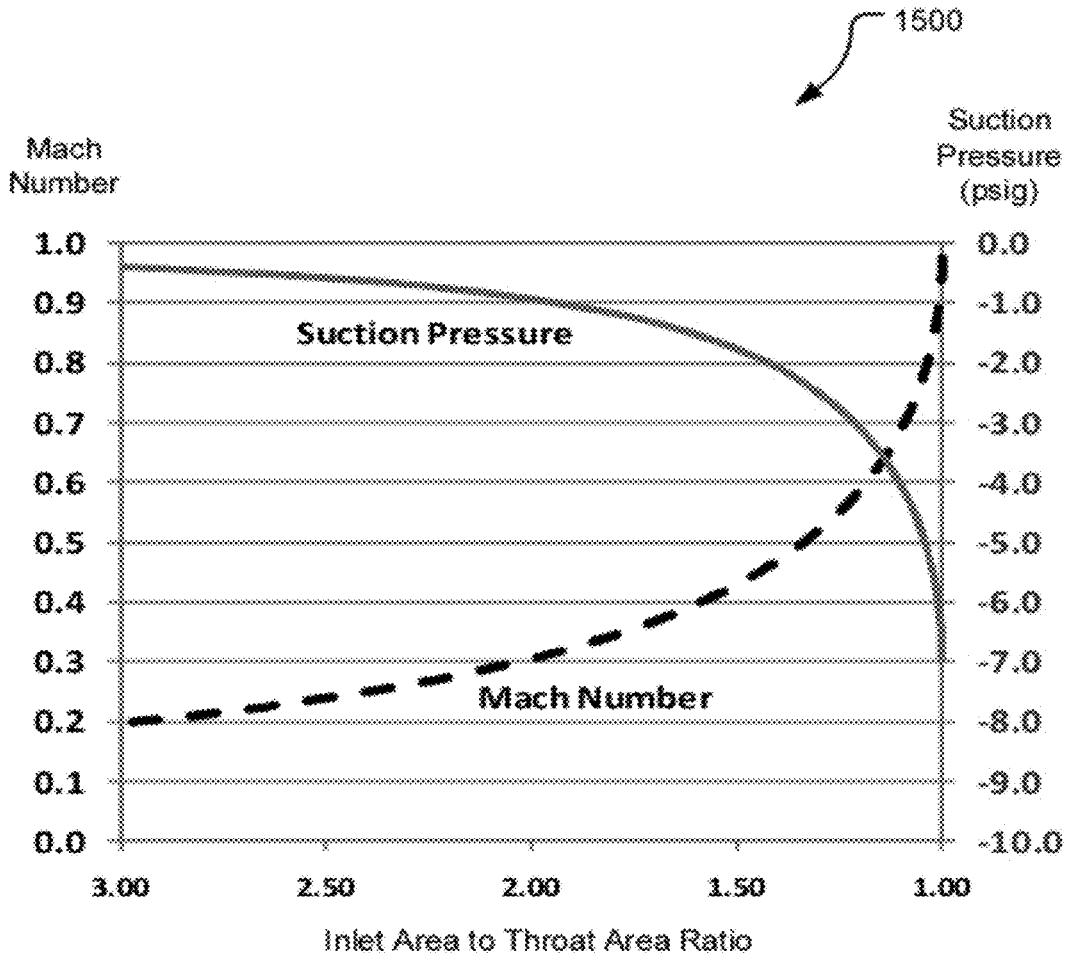
FIG. 15 illustrates a graph of an effect of venturi inlet area to venturi throat area ratio on suction pressure and Mach number in an example throttleable exhaust venturi.

FIG. 15 illustrates a graph 1500 of an effect of venturi inlet area to venturi throat area ratio on suction pressure and Mach number in an example throttleable exhaust venturi. Graph 1500 illustrates the sensitivity of the ambient fluid flow streamline Mach number and corresponding static suction pressure to small changes in cross-sectional venturi flow area relative to the minimum flow area in the venturi throat region. The relatively large potential variations in throat gap area associated with changes in the combustion exhaust gas output relative to the large drop-off in ambient flow streamline static suction pressure creates a major constraint in the design of a exhaust venturi that operates over a large range of output exhaust conditions (i.e., "throttleable"). The design of the venturi in close proximity to the exhaust gas port(s) assures that the streamlines surrounding the exhaust gas port(s) are all high velocity (e.g., subsonic compressible fluid flow velocities) over a wide range of exhaust gas port boundary layer conditions.

In designing the throttleable exhaust venturi downstream of the venturi throat, fluid mixing is addressed. Because the combustion exhaust gasses move at relatively low Mach numbers in proximity of the venturi throat as compared to the ambient fluid Mach numbers, in order to achieve strong stagnation suction pressures on the combustion exhaust gasses, the ambient fluid stream and the combustion exhaust fluid stream are mixed. More specifically, for the two fluid streams to recover back up to atmospheric pressure and exit the throttleable exhaust venturi into local ambient pressure conditions, mixing occurs in a region downstream of the venturi throat.

To provide an example, Eq. 5 illustrates the combustion exhaust Mach number at the throat for both producing ambient stagnation pressure at the exhaust outlet. Eq. 5 assumes no mixing with the ambient fluid stream and a static pressure at the throat equivalent to the static pressure of ambient fluid moving at sonic speeds in the throat.

$$M_{engine,2} = \sqrt{\left(\frac{2}{(\gamma_{engine} - 1)}\right)\left[\left(1 + \frac{(\gamma_{air} - 1)}{2}M_{air,2}^2\right)^{\frac{\gamma_{air}(\gamma_{engine}-1)}{\gamma_{engine}(\gamma_{air}-1)}} - 1\right]}, \tag{5}$$

where $\gamma_{air}$ is the specific heat ratio of the ambient fluid, $\gamma_{engine}$ is the specific heat ratio of the combustion exhaust gas, $M_{air,2}$ is the Mach number of the input ambient fluid stream at the venturi throat, and $M_{engine,2}$ is the Mach number of the combustion exhaust gas at the venturi throat. For a standard air temperature specific heat ratio, $\gamma_{air} \approx 1.4$ and an example combustion exhaust gas exhaust temperature specific heat ratio, $\gamma_{engine} \approx 1.29$, for a sonic air stream at the venturi throat, the Mach number of combustion exhaust gas entering the venturi throat may be greater than sonic velocity ($M_{engine,2} > 1$) in order to assure these gases can exit at atmospheric pressure. This unmixed two-fluid stream results in combustion exhaust stagnation pressures greater than ambient pressure in the venturi, which may not allow the venturi to operate effectively.

This produces an effect opposite of the intended objective—it generates back-pressure on the exhaust. In an unmixed fluid stream venturi, for an exhaust gas velocity to recover back to atmospheric pressure, the stagnation pressure must be equal to or greater than atmospheric pressure. Upstream of the venturi exhaust ports, the exhaust gas stagnation pressure at the engine exhaust outlet will be even greater due to frictional losses in the exhaust system. The other extreme to the unmixed fluid streams are fully mixed fluid streams downstream of the venturi throat, wherein the momentum, mass flow rates, and energy contained in the two fluid streams are combined into a single stream. This case is analyzed below.

The gas dynamics of two interacting fluid streams obey three fundamental conservation laws—conservation of mass, conservation of energy, and conservation of momentum. Below is an example derivation of a 1-D gas dynamics model with some reasonable, but simplifying assumptions (e.g., 1-D fluids flow and negligible heat losses to the external environment). The conservation laws apply at any cross section in a fluid stream.

Three candidate cross-sectional areas are identified in FIG. 5. For example, region 1 corresponds to the cross-sectional area of the ambient fluid flow at field location 556. Region 2 corresponds to field location 558 and addresses the effective cross-sectional areas of both the ambient fluid flow and combustion exhaust gases. Region 3 corresponds to field location 560 or the point in the exit nozzle where the combined ambient/combustion exhaust fluid streams are at local atmospheric pressure and tend to separate away from the nozzle wall. For purposes of understanding the influence of perfect mixing compared to non-mixing, we address the fluid streams at Region 2 and Region 3 in detail below.

Continuity (Conservation of Mass) holds that:

$$\dot{m}_{tot} = \dot{m}_{air} + \dot{m}_{engine} = (\varepsilon + 1)\dot{m}_{engine}, \tag{6}$$

$$\text{where } \varepsilon \equiv \frac{\dot{m}_{air}}{\dot{m}_{engine}}, \tag{7}$$

$$A_{air,2} = \frac{\dot{m}_{air}}{P_{venturi} M_{air,2}} \sqrt{\frac{R_{air} T_{air}}{\gamma_{air}\left(1 + \frac{(\gamma_{air} - 1)}{2} M_{air,2}^2\right)}}, \tag{8}$$

$$A_{engine,2} = \frac{\dot{m}_{engine}}{P_{venturi} M_{engine,2}} \sqrt{\frac{R_{engine} T_{engine}}{\gamma_{engine}\left(1 + \frac{(\gamma_{engine} - 1)}{2} M_{engine,2}^2\right)}}, \text{ and} \tag{9}$$

$$A_{mix,3} = \frac{\dot{m}_{engine}(\varepsilon + 1)}{P_{atm} M_{mix,3}} \sqrt{\frac{R_{mix} T_{mix}}{\gamma_{mix}\left(1 + \frac{(\gamma_{mix} - 1)}{2} M_{mix,3}^2\right)}}, \tag{10}$$

where $\dot{m}_{tot}$ is the total combined mass flow rate of ambient fluid and combustion exhaust; $\dot{m}_{engine}$ is the mass flow rate of the combustion exhaust; $\dot{m}_{air}$ is the mass flow rate of ambient fluid; $\gamma_{air}$ is the specific heat ratio of the ambient fluid; $\gamma_{engine}$ is the specific heat ratio of the combustion exhaust; $\gamma_{mix}$ is the specific heat ratio of the mixed fluids; $P_{atm}$ is atmospheric pressure; $P_{venturi}$ is the static pressure of the fluid flow in the venturi throat region; $M_{air,2}$ is the Mach number of ambient fluid at the venturi throat (approx. Region 2); $M_{engine,2}$ is the Mach number of combustion exhaust gases entering the venturi throat (approx. Region 2); $M_{mix,3}$ is the Mach number of mixed gases at Region 3 exiting the venturi; $A_{air,2}$ is the cross-sectional area of ambient fluid streamlines at the throat (approx. Region 2); $A_{engine,2}$ is the cross-sectional area of the combustion exhaust streamlines into the venturi throat (approx. Region 2); $A_{mix,3}$ is the cross-sectional area of the mixed fluid streamlines exiting the venturi into the atmosphere (approx. Region 3); $R_{air}$, $R_{engine}$ are the gas constants of the ambient fluid and the combustion exhaust gases, respectively, in the vicinity of Region 2; $R_{mix}$ is the gas constant of the mixed fluid in the vicinity of Region 3; $T_{air}$, $T_{engine}$ are the stagnation temperatures of the ambient fluid and the combustion exhaust gases respectively in the vicinity of Region 2. $T_{mix}$ is the stagnation temperature of the mixed fluid in the vicinity of Region 3.

Conservation of Energy holds that:

$$(\dot{m}_{air} + \dot{m}_{engine}) \int_{T_{ref}}^{T_{mix}} c_{p,mix} dT = \dot{m}_{air} \int_{T_{ref}}^{T_{air}} c_{p,air} dT + \dot{m}_{air} \int_{T_{ref}}^{T_{engine}} c_{p,engine} dT - \dot{Q}_{loss}, \tag{11}$$

where $c_{p,air}$ is the specific heat of the ambient fluid, $c_{p,engine}$ is the specific heat of the combustion exhaust, and $c_{p,mix}$ is the specific heat of the mixed fluids. $T_{ref}$ is an arbitrary reference state temperature that is consistent for all of the fluid streams. $\dot{Q}_{loss}$ is the heat loss from the fluids to an external environment. All other variables have been previously defined above.

Although a rigorous thermodynamic analysis may be used to solve the mixture temperature, $T_{mix}$ in Eq. 12, for cases where heat loss can be assumed negligible, a reasonable approximation for estimating $T_{mix}$ from Eq. 12 can be derived assuming $c_{p,mix} \approx c_{p,air} \approx c_{p,engine} \approx$ a constant over the relative low temperature changes for this particular gas dynamics application.

$$T_{mix} \approx \frac{\varepsilon T_{air} + T_{engine}}{\varepsilon + 1}. \tag{12}$$

Conservation of Momentum at the Region 3 exhaust outlet, assuming uniform, complete mixing through nozzle holds that:

$$P_{atm}(1+\gamma_{mix}M_{mix,3}^2)A_{mix,3} = (1-\eta)[P_{venturi}(1+\gamma_{air}M_{air,2}^2)A_{air,2} + P_{venturi}(1+\gamma_{engine}M_{engine,2}^2)A_{engine,2}], \tag{13}$$

where $0<\eta<1$ is the fraction of gas momentum losses in the throttleable exhaust venturi due to various loss mechanisms such as friction and drag interactions between the fluid streams and the various solid surfaces of the throttleable exhaust venturi. All of the additional variables have been previously defined.

Combining Eqs. 7-10 and Eq. 13, the governing equation for combining two fluid streams into a mixed gas stream downstream of the venturi throat is derived as follows:

$$\frac{(\varepsilon + 1)(1 + \gamma_{mix} M_{mix,3}^2)}{(1 - \eta) M_{mix,3}} \sqrt{\frac{R_{mix} T_{mix}}{\gamma_{mix}\left(1 + \frac{(\gamma_{mix} - 1)}{2} M_{mix,3}^2\right)}} = \varepsilon \frac{(1 + \gamma_{air} M_{air,2}^2)}{M_{air,2}} \sqrt{\frac{R_{air} T_{air}}{\gamma_{air}\left(1 + \frac{(\gamma_{air} - 1)}{2} M_{air,2}^2\right)}} + \frac{(1 + \gamma_{engine} M_{engine,2}^2)}{M_{engine,2}} \sqrt{\frac{R_{engine} T_{engine}}{\gamma_{engine}\left(1 + \frac{(\gamma_{engine} - 1)}{2} M_{engine,2}^2\right)}}, \tag{14}$$

where all of the variables have been previously defined. $T_{mix}$ can be solved using either Eq. 11 or Eq. 12.

Unlike Eq. 5 associated with non-mixed flow, Eq. 15 associated with uniformly mixed fluid streams downstream of the venturi throat allows for a wide range of solutions for both meeting the atmospheric outlet pressure conditions and producing strong suction pressure in the venturi by simultaneously allowing low combustion exhaust Mach numbers as well as high combustion exhaust Mach numbers (see e.g., FIG. 12, which depicts high ambient fluid venturi throat Mach numbers all the way up to sonic velocity). Operation under both low and high combustion exhaust Mach numbers allows the venturi to consistently generate low suction pressures at an engine exhaust port.

Figure 16:
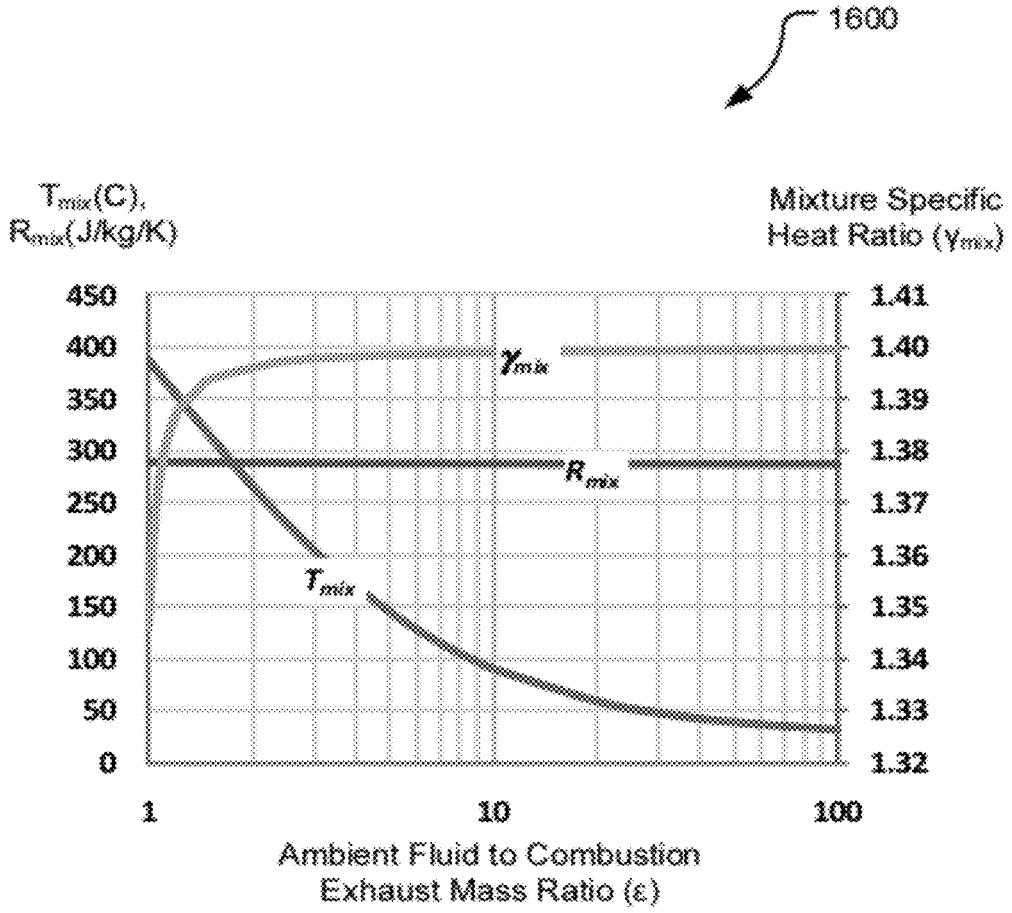
FIG. 16 is a graph illustrating changes in properties of a uniformly mixed fluid stream of ambient fluid and combustion exhaust as a function of ambient fluid to combustion exhaust mass ratio in an example throttleable exhaust venturi.

FIG. 16 is a graph 1600 illustrating changes in properties of a uniformly mixed fluid stream of ambient fluid and combustion exhaust as a function of ambient fluid to combustion exhaust mass ratio in an example throttleable exhaust venturi. A discussed in detail below FIG. 16 illustrates that accounting for changes in fluid properties with ambient fluid to combustion exhaust mixture ratio may be important, particularly with regard to the mixed fluid temperature.

Figure 17:
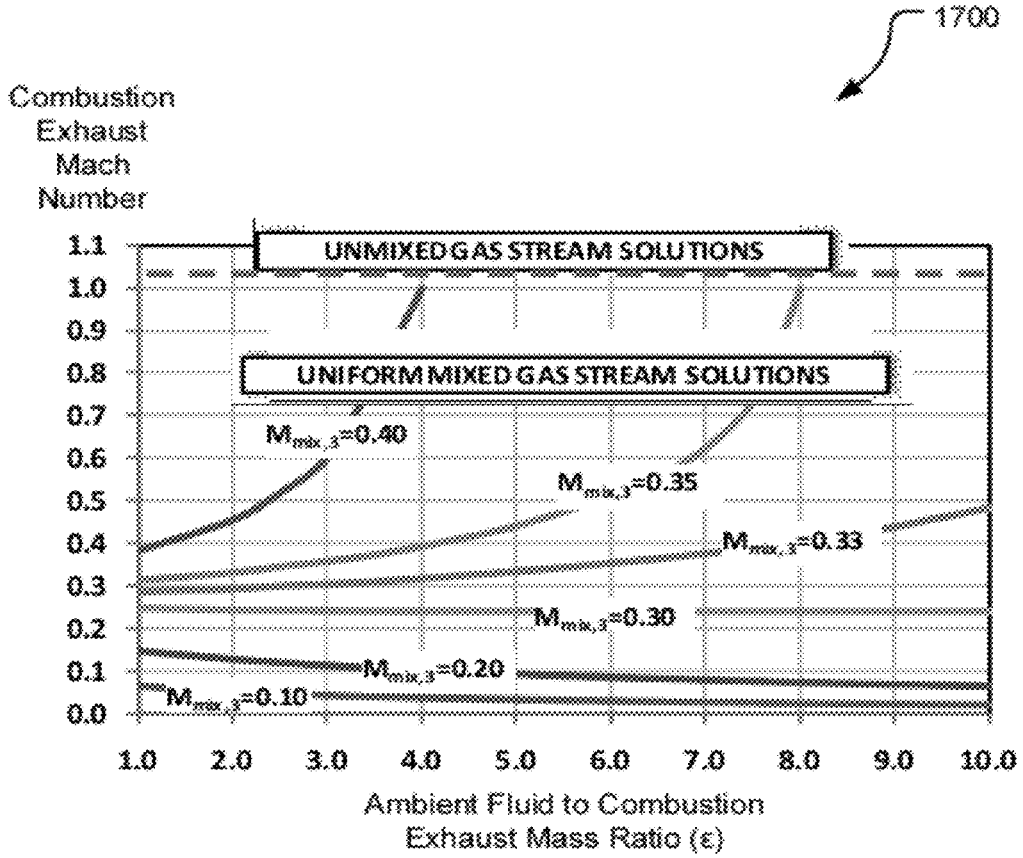
FIG. 17 is a graph illustrating combustion exhaust gas Mach number as a function of ambient fluid to combustion exhaust mass ratio for completely unmixed fluid streams and a perfectly mixed fluid stream flowing through a throat of an example throttleable exhaust venturi.

FIG. 17 is a graph 1700 illustrating combustion exhaust gas Mach number as a function of ambient fluid to combustion exhaust mass ratio for completely unmixed fluid streams and a perfectly mixed fluid stream flowing through a throat of an example throttleable exhaust venturi. The perfectly mixed fluid stream solutions assume a negligible heat loss throughout the venturi and a 10% loss in combined fluid momentum due to, for example, drag between the fluid streams and interior walls of the venturi. The perfectly mixed fluid stream solutions are plotted as a family of curves for mixed exhaust gas exit Mach number, which is ultimately dependent at least on the cross-sectional area of the outlet.

Three candidate cross-sectional areas of the example throttleable exhaust venturi are identified in FIG. 5. For example, region 1 corresponds to the cross-sectional area of the ambient fluid flow at field location 556. Region 2 corresponds to field location 558 and addresses the effective cross-sectional areas of both the ambient fluid flow and combustion exhaust gases. Region 3 corresponds to field location 560 or the point in the exit nozzle where the combined ambient/combustion exhaust fluid streams are at local atmospheric pressure and tend to separate away from the nozzle wall. For purposes of understanding the influence of perfect mixing compared to non-mixing, we address the fluid streams at Region 2 and Region 3 in detail below.

Mixing of the ambient fluid and the combustion exhaust fluid streams downstream of the throat along with having relatively low outlet Mach numbers (achieved with large Region 2 engine exhaust port exit areas) contributes to achieving a low combustion exhaust Mach number, which allows for low engine exhaust suction pressures. Unmixed gas streams may have very high, even supersonic, combustion exhaust Mach number at the throat, which based on FIG. 13, significantly limits the suction pressures that are achievable and in some cases, even worse, adds stagnation back pressure to the throttleable exhaust venturi.

An example case of additional design considerations for accounting for the influence of different combustion exhaust throttling conditions from a combustion engine is provided below. Changing combustion exhaust mass flow rates alters the ambient air to combustion exhaust Mass Flow Ratios, $\epsilon$, according to the following:

$$\frac{\varepsilon_2}{\varepsilon_1} = \left(\frac{\dot{m}_{air,2}}{\dot{m}_{air,1}}\right)\left(\frac{\dot{m}_{engine,1}}{\dot{m}_{engine,2}}\right), \tag{15}$$

where all of the variables have been previously defined. Subscripts 1 and 2 define two relative throttling states of the combustion exhaust mass flow rate.

Combustion exhaust mass flow rates in Eq. 15 can be derived by rearranging Eq. 9:

$$\dot{m}_{engine} = A_{engine,2} P_{venturi} M_{engine,2} \sqrt{\frac{\gamma_{engine}\left(1 + \frac{(\gamma_{engine} - 1)}{2} M_{engine,2}^2\right)}{R_{engine} T_{engine}}}, \tag{16}$$

where the variables have all been previously defined. From Eq. 16, the ratios of engine exhaust mass flow rates between two states can be derived:

$$\frac{\dot{m}_{engine,2}}{\dot{m}_{engine,1}} = \frac{M_{engine,2,2}}{M_{engine,2,1}} \sqrt{\frac{\left(1 + \frac{(\gamma_{engine} - 1)}{2} M_{engine,2,2}^2\right)}{\left(1 + \frac{(\gamma_{engine} - 1)}{2} M_{engine,2,1}^2\right)}} \tag{17}$$

where the variables have all been previously defined, but with some additional nomenclature. $M_{engine,x,y}$ is the Mach number in region x of the throttleable exhaust venturi for a comparative throttling state y.

For convenience, Eq. 17 can be defined relative to the maximum combustion exhaust gas output, which may approximately correspond to the maximum power output of an combustion engine:

$$\mu \equiv \frac{\dot{m}_{engine}}{\dot{m}_{engine,max}} = \frac{M_{engine,2}}{M_{engine,2,max}} \sqrt{\frac{\left(1 + \frac{(\gamma_{engine} - 1)}{2} M_{engine,2}^2\right)}{\left(1 + \frac{(\gamma_{engine} - 1)}{2} M_{engine,2,max}^2\right)}}, \tag{18}$$

where all of the variables and parameters have been previously defined.

As discussed above, the effective throat area and/or location typically changes as the combustion exhaust mass flow rate changes because the higher the combustion exhaust mass flow rates, the more the combustion exhaust gases "pinch" the ambient fluid stream lines in the throat region. For an example a sonic choked venturi, the ambient fluid mass flow rate is going to be effectively controlled by the effective area of the ambient fluid streamlines in the throat. To account for this effect of changing combustion exhaust mass flow rates altering the ambient fluid air mass flow rates due to changes in effective cross-sectional area of the ambient fluid streamlines at the throat, one example model that can be potentially fit to experimental data is:

$$\left(\frac{\dot{m}_{air,2}}{\dot{m}_{air,1}}\right) = f\left(\frac{\dot{m}_{engine,2}}{\dot{m}_{engine,1}}\right) \approx \left(\frac{\dot{m}_{engine,2}}{m_{engine,1}}\right)^{-\sigma}, \tag{19}$$

where $\sigma$ is an experimentally fit parameter, which would typically be a positive number. For example, for $\sigma$=0, the ambient fluid stream would not be altered at all by the combustion exhaust gas stream. For progressively larger positive numbers, increasing rates of combustion exhaust gas flow would decrease the mass flow rate of ambient fluid by reducing the effective throat cross-sectional area for the ambient fluid. Substituting Eq. 17 and Eq. 19 into Eq. 15, the corresponding ratio of ambient fluid to combustion exhaust mass flow ratios between two throttling scenarios can be derived:

$$\frac{\varepsilon_2}{\varepsilon_1} = \left(\frac{\dot{m}_{engine,1}}{\dot{m}_{engine,2}}\right)^{\sigma+1} = \left[\left(\frac{M^2_{engine,2,1}}{M^2_{engine,2,2}}\right)\frac{\left(1+\frac{(\gamma_{engine}-1)}{2}M^2_{engine,2,1}\right)}{\left(1+\frac{(\gamma_{engine}-1)}{2}M^2_{engine,2,2}\right)}\right]^{\frac{\sigma+1}{2}}, \tag{20}$$

where all of the parameters have been previously defined. Eq. 18 can be substituted into Eq. 20 for relating output approximately to the maximum power output condition of the combustion engine.

$$\frac{\varepsilon_2}{\varepsilon_{max,power}} \approx \mu^{-(\sigma+1)} = \left[\left(\frac{M^2_{engine,2,1}}{M^2_{engine,2,max}}\right)\frac{\left(1+\frac{(\gamma_{engine}-1)}{2}M^2_{engine,2,1}\right)}{\left(1+\frac{(\gamma_{engine}-1)}{2}M^2_{engine,2,max}\right)}\right]^{\frac{\sigma+1}{2}}, \tag{21}$$

From Eqs. 4, 9, 10, the following relationship for mixed fluid stream exit area relative to the combustion exhaust cross-sectional area entering the venturi throat can be derived:

$$\frac{A_{mix,3}}{A_{engine,2}} = (\varepsilon+1)\left(1+\frac{(\gamma_{air}-1)}{2}M^2_{air,2}\right)^{-\left(\frac{\gamma_{air}}{(\gamma_{air}-1)}\right)} \times \frac{M_{engine,2}}{M_{mix,3}}\sqrt{\frac{\gamma_{engine}R_{mix}T_{mix}\left(1+\frac{(\gamma_{engine}-1)}{2}M^2_{engine,2}\right)}{\gamma_{mix}R_{engine}T_{engine}\left(1+\frac{(\gamma_{mix}-1)}{2}M^2_{mix,3}\right)}} \tag{22}$$

where all of the parameters have been previously defined.

Figure 18:
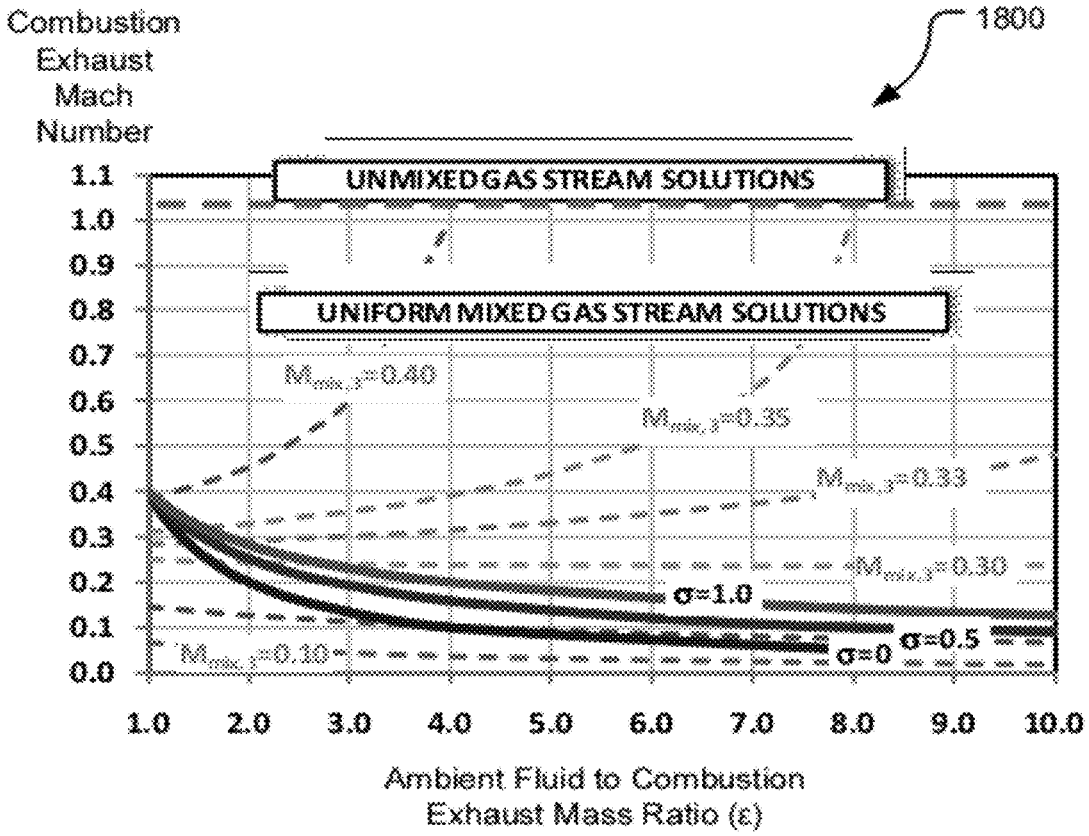
FIG. 18 is a graph illustrating a subset of solutions from FIG. 17 with an additional design constraint associated with how three different example venturi throat designs vary the effective throat cross-sectional area with an increasing combustion exhaust mass flow rate.

FIG. 18 is a graph 1800 illustrating a subset of solutions from FIG. 17 with an additional design constraint associated with how three different example venturi throat designs (i.e., $\sigma=0$, $\sigma=0.5$, and $\sigma=1$) vary the effective throat cross-sectional area with an increasing combustion exhaust mass flow rate. In all three of these example throat designs, peak combustion exhaust mass flow rate is assumed to occur at an ambient fluid to combustion exhaust mass ratio of about 1 with a corresponding peak combustion exhaust Mach number of about 0.4.

The three different approximate models of fluid stream interactions at the throat as described in Eq. 21 for $\sigma$ illustrate how fluid stream interactions at the throat puts additional constraints on the design of a sonic or near-sonic throttleable exhaust venturi. In all three of these example throat designs, peak combustion exhaust mass flow rate (and approximate peak engine power) is assumed to occur at an ambient fluid to combustion exhaust mass ratio of 1.0 with a corresponding peak combustion exhaust Mach number of 0.4. This ensures strong suction is achieved even at peak engine power.

Figure 19:
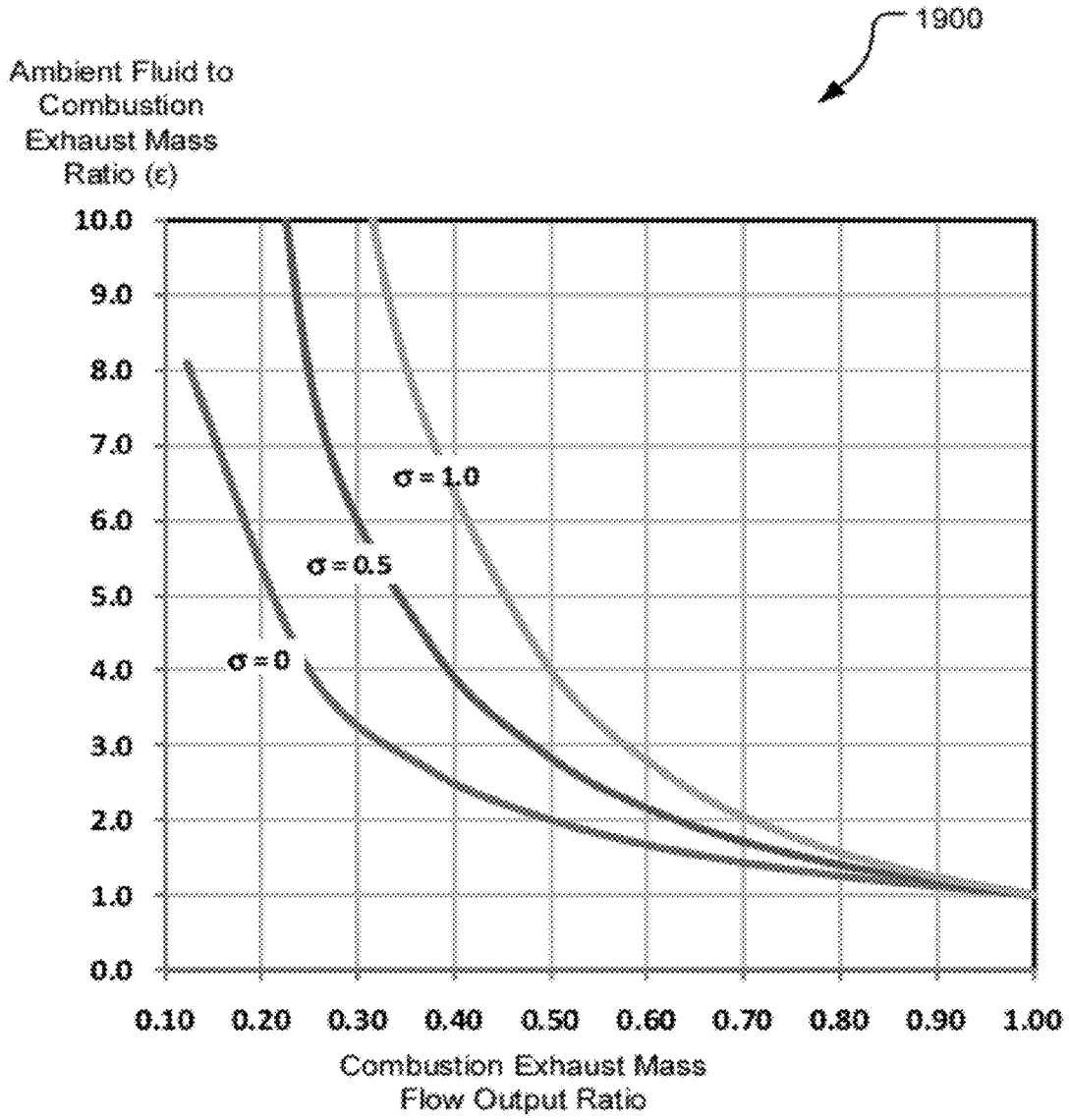
FIG. 19 is a graph illustrating how ambient fluid to combustion exhaust mass flow ratios vary with different combustion exhaust mass flow output ratios for the three different example venturi throat designs of FIGS. 17 and 18.

FIG. 19 is a graph 1900 illustrating how ambient fluid to combustion exhaust mass flow ratios vary with different combustion exhaust mass flow output ratios for the three different example venturi throat designs (i.e., $\sigma=0$, $\sigma=0.5$, and $\sigma=1$) of FIGS. 17 and 18.

Figure 20:
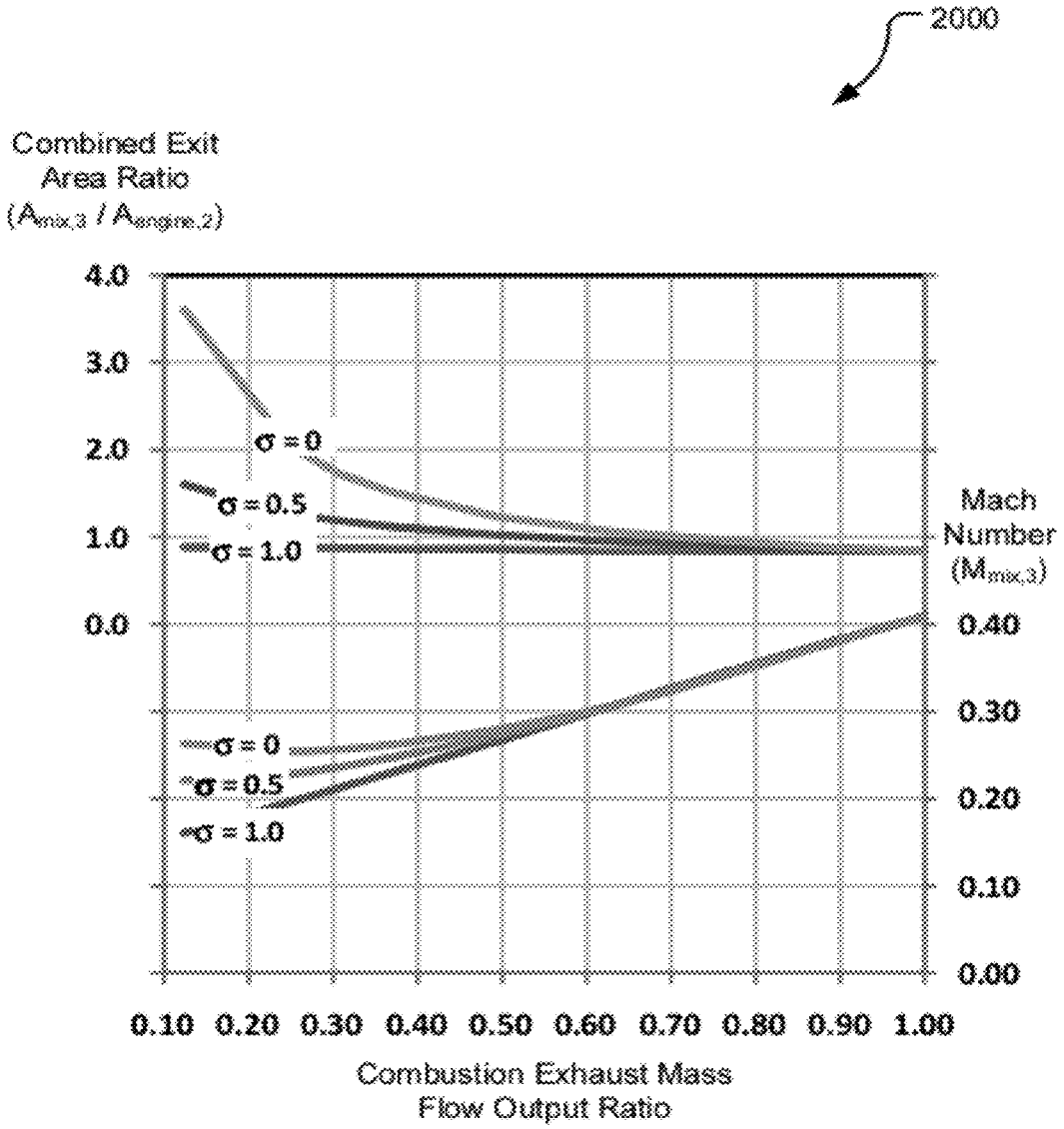
FIG. 20 is a graph illustrating uniformly mixed venturi exit areas relative to combustion engine port cross-sectional exit areas in order to achieve an appropriate atmospheric outlet pressure as a function of the combustion exhaust mass flow ratio for the three different example throttling venturi throat designs of FIGS. 17, 18, and 19.

FIG. 20 is a graph 2000 illustrating uniformly mixed venturi exit areas relative to combustion engine port cross-sectional exit areas in order to achieve an appropriate atmospheric outlet pressure as a function of the combustion exhaust mass flow ratio for the three different example throttling venturi throat designs (i.e., $\sigma=0$, $\sigma=0.5$, and $\sigma=1$) of FIGS. 17, 18, and 19.

Three candidate cross-sectional areas of the example throttleable exhaust venturi are identified in FIG. 5. For example, region 1 corresponds to the cross-sectional area of the ambient fluid flow at field location 556. Region 2 corresponds to field location 558 and addresses the effective cross-sectional areas of both the ambient fluid flow and combustion exhaust gases. Region 3 corresponds to field location 560 or the point in the exit nozzle where the combined ambient/combustion exhaust fluid streams are at local atmospheric pressure and tend to separate away from the nozzle wall. For purposes of understanding the influence of perfect mixing compared to non-mixing, we address the fluid streams at Region 2 and Region 3 in detail below.

The corresponding Mach number at the exit cross-sectional area (e.g., at Region 3 of FIG. 5) is shown. This variable outlet area is accommodated in one implementation with a diverging exit nozzle for the venturi. The exit areas define the appropriate atmospheric outlet pressure for the three depicted throttling venturi throat designs and are a factor in designing the contours of the overall near-sonic or sonic throttleable exhaust venturi cross-sections.

For example, for system contours that produce an Eq. 21 profile with $\sigma\approx1.0$, the Region 3 exit area is about constant regardless of combustion exhaust throttling conditions. For small changes in the Region 3 exit area, a diverging cone into the atmosphere may be used. A venturi design that meets all of the sonic/near-sonic streamline constraints previously defined along with an ambient fluid stream venturi throat interaction model that approximates Eq. 21 with $\sigma\approx1.0$ produces a sonic/near-sonic venturi design that can passively compensate for changing combustion exhaust output conditions over a wide range of throttling conditions. For alternative designs that fit Eq. 21 with $\sigma\rightarrow0$, the outlet area (Region 3) of the overall sonic/near-sonic venturi exhaust system may change appreciably with varying engine exhaust output conditions. This constraint can be addressed with mechanisms (e.g., an adjustable outlet nozzle such as an ejector nozzle or an iris nozzle) that effectively change the exit area of the mixed fluid stream exiting the venturi into the atmosphere.

In one implementation, working with the equations above, several additional constraints on the venturi design may come to light. First, a negative gauge pressure, low subsonic fluid stream that does not mix with a sonic velocity ambient air fluid stream may not yield velocity and stagnation pressure conditions that allow the two fluid streams both to recover back up to local atmospheric pressure and achieve any substantial suction pressure. More specifically, if the two fluid streams are not effectively mixed, suction pressure draws in the atmosphere into the outlet nozzle of the venturi and collapses the venturi such that high velocity (e.g., subsonic compressible fluid flow velocity) conditions inside the venturi throat are not produced. In some cases, a back-pressure may be produced. Subsonic compressible ambient fluid stream venturi throat Mach numbers (and the corresponding strong suction pressure) can be attained by very thoroughly mixing the momentum and energy (thermal and kinetic) of the two fluid streams and having this mixed fluid stream recover back up to atmospheric pressure. Therefore, the presently disclosed throttleable venturi contains a very efficient variable throat and mixing region for thoroughly mixing the two fluid streams. This variable throat and mixing region is downstream of the venturi and prior to the mixed fluid stream exiting into the local atmosphere.

In another implementation, a second constraint is the relative ratios of ambient fluid mass flow to combustion exhaust air mass flow. At ambient fluid to combustion exhaust mass ratios less than 0.1, the throttleable venturi does not produce sufficient fluid momentum and energy to mix with and recover the combined fluid stream back up to local atmospheric pressure. At ambient fluid to combustion exhaust mass ratios of ~2:1, the throttleable venturi performs marginally. At greater mass ratios in the range of 1:1 to 100:1, the throttleable venturi performs well. The throttleable venturi can operate at much higher mass flow ratios by incorporating a larger venturi cross-sectional area and a corresponding much larger venturi inlet area. However, at some point, vehicle drag, packaging and aesthetics may effectively limit this upper bound on relative mass flow ratios.

The National Advisory Committee for Aeronautics (NACA) has developed a series of airfoil shapes (e.g., wing designs, lifting shapes, etc.) for aircraft wings identified by a series of digits following the word "NACA." In some implementations, the NACA airfoil shapes may be deflected from a planar orientation to a circular, oval, or other closed shape and form the interior contour of the Venturi Exhaust disclosed herein.

Figure 21:
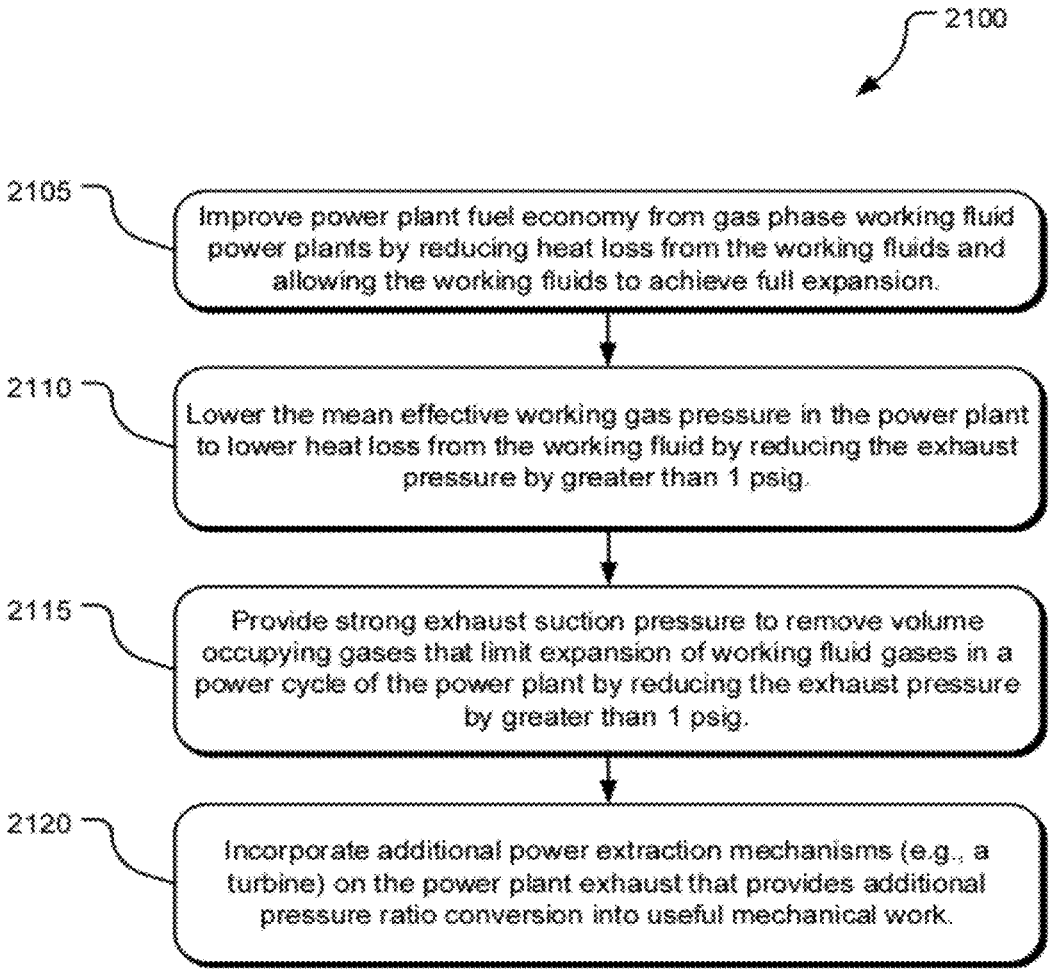
FIG. 21 illustrates example operations for improving engine fuel efficiency by applying suction pressure at a combustion exhaust outlet.

FIG. 21 illustrates example operations 2100 for improving engine fuel efficiency by applying suction pressure at a combustion exhaust outlet. An improving operation 2105 improves power plant fuel economy from gas phase working fluid power plants by reducing heat loss from the working fluids and allowing the working fluids to achieve full expansion.

A lowering operation 2110 lowers the mean effective working gas pressure in the power plant to lower heat loss from the working fluid by reducing the exhaust pressure by greater than 1 psi negative gauge pressure, given a near linear response of heat loss from a gas phase working fluid with gas pressure. A providing operation 2115 provides more expansion of working fluid gases in the power plant in order to extract additional work by providing strong exhaust suction pressure to remove volume occupying gases that limit expansion of working fluid gases in a power cycle of the power plant by reducing the exhaust pressure by greater than 1 psi negative gauge pressure.

In one implementation, the lowering operation 2110 and the providing operation 2115 are accomplished by adjusting a negative gauge pressure applied to a combustion engine exhaust based on a mass flow rate of the combustion engine exhaust. In a further implementation, the lowering operation 2110 and the providing operation 2115 are accomplished by measuring the mass flow rate of the combustion engine exhaust and providing the measured the mass flow rate to a controller for a vacuum pump that applies the negative gauge pressure to the combustion engine exhaust.

An incorporation operation 2120 incorporates additional power extraction mechanisms (e.g., a turbine) on the power plant exhaust that provides additional pressure ratio conversion into useful mechanical work. In various implementations, one or more of the operations 2100 are utilized in or with a throttleable exhaust venturi according to the presently disclosed technology.

Figure 22:
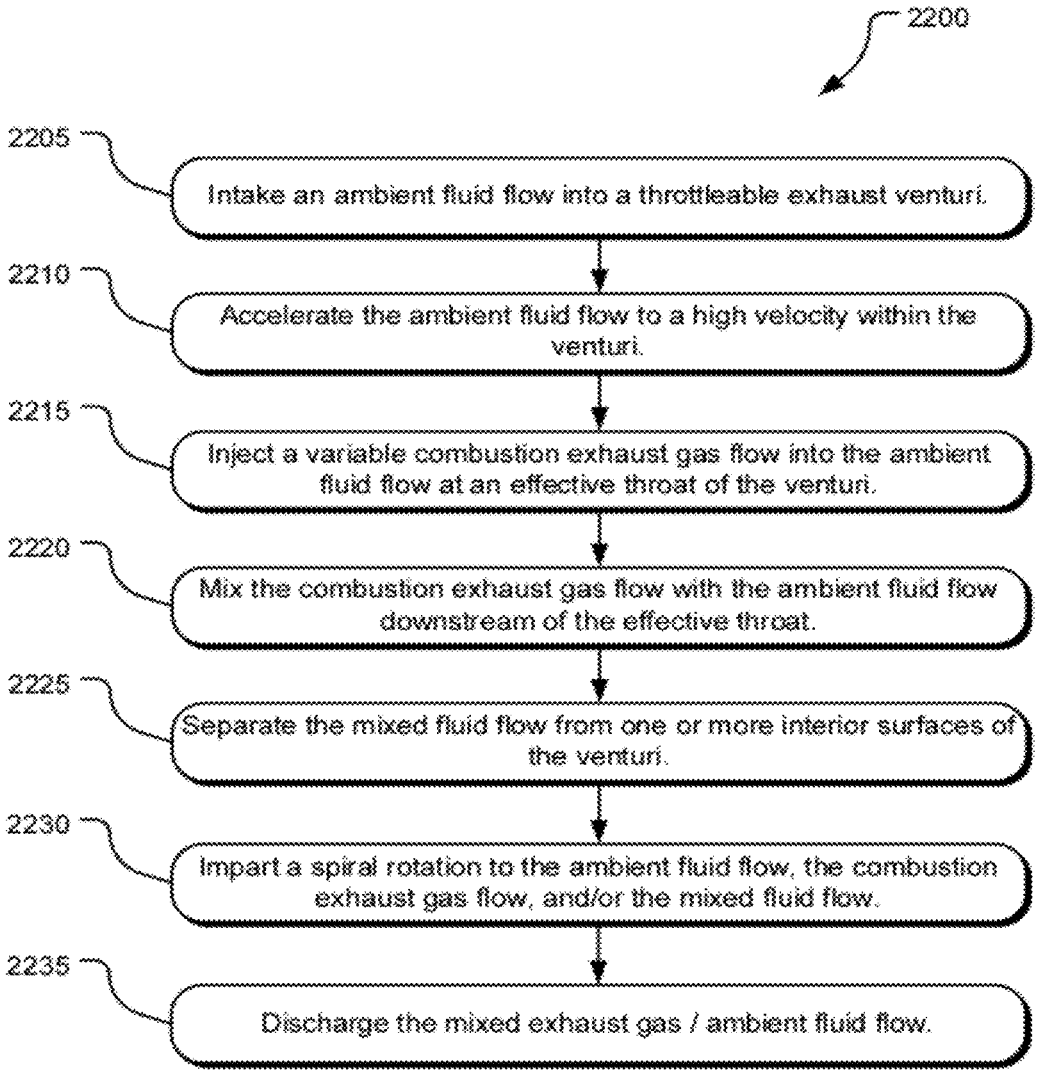
FIG. 22 illustrates example operations for using a throttleable exhaust venturi to increase the fuel efficiency of an engine.

FIG. 22 illustrates example operations 2200 for using a throttleable exhaust venturi to increase the fuel efficiency of an engine. Intake operation 2205 intakes an ambient fluid flow into a throttleable exhaust venturi. In an example implementation, the throttleable exhaust venturi is attached to a moving vehicle. Motion of the vehicle creates a high-velocity (e.g., a subsonic compressible fluid flow velocity) ambient fluid flow of air through the venturi. An accelerating operation 2210 accelerates the subsonic velocity ambient fluid flow to the high-velocity velocity. In one implementation, this acceleration is accomplished using the venturi. The cross sectional area of the venturi exhaust system is reduced sufficiently to accelerate the ambient fluid flow to a high velocity.

An injecting operation 2215 injects a variable gas flow into the high-velocity ambient fluid flow at an effective throat of the venturi. In an implementation utilizing a combustion engine, the combustion engine exhaust may have a variable exhaust mass flow rate (due to the combustion engine's varying power output, for example). The exit of the combustion engine exhaust into the venturi exhaust system is at or near a physical throat of the venturi exhaust system and creates a variable effective venturi throat. The venturi is configured to operate over a wide operating range of the combustion engine (especially with regard to combustion exhaust gas flow rates).

The orientation of the combustion engine exhaust near the venturi throat creates a local low-pressure zone at the combustion engine exhaust. The result is a negative gage pressure at the combustion engine exhaust, which provides suction on the combustion engine exhaust. This characteristic creates significant efficiency gains, as discussed in detail above.

A mixing operation 2220 mixes the injected combustion exhaust gas flow with the high-velocity ambient fluid flow downstream of the effective throat of the venturi. The local low-pressure zone at the engine exhaust may be in danger of being collapsed by ambient fluid at atmospheric pressure reverse flowing through a discharge of the venturi. Mixing operation 2220 prevents this reverse ambient fluid flow, which also prevents the local low-pressure zone from being collapsed. A separation operation 2225 allows the mixed fluid flow to separate from one or more interior surfaces of the venturi at a point where the mixed fluid stream is at a local ambient external pressure. In one implementation, the venturi employs an expansion cone downstream of where the injected combustion exhaust gas flow is mixed with the ambient fluid flow. When the mixed fluid flow recovers up to about an external pressure, the mixed fluid flow separates from the interior surfaces of the venturi.

An imparting operation 2230 imparts a spiral rotation to the ambient fluid flow, the combustion exhaust fluid flow and/or the mixed fluid flow. The imparting operation 2230 may be accomplished using one or more vortex generators placed within the fluids flowing through the venturi. The spiral rotation "stiffens" the fluid flows, making them less susceptible to changes in fluid flow direction. A discharging operation 2235 discharges the mixed exhaust gas/ambient fluid. Downstream of the effective throat, the venturi increases in cross sectional area, thereby reducing the velocity of the mixed fluid until the mixed fluid is discharged from the venturi. In various implementations, one or more of the operations 2200 are utilized in or with a throttleable exhaust venturi according to the presently disclosed technology.

In one implementation, NACA 4424, which has a high lift ratio airfoil shape, is utilized as a template for the interior surface contour of a throttleable exhaust venturi. The NACA 4424 helps accelerate the ambient fluid stream in a low loss manner in order to create a low-pressure area directly over the exit ports of the combustion exhaust, which creates a draw on the exhaust gases exiting the ports, thereby initiating a vacuum that extracts the exhaust gases out of a combustion engine. Other NACA profiles with varying lift ratios could be implemented to create the low-pressure area over the exit ports of the combustion exhaust. Further, any venturi shape, design, or form could be implemented to create a low-pressure area directly over the exit ports of the combustion exhaust.

FIG. 21 illustrates example road test trials utilizing a throttleable exhaust venturi based on the design principles disclosed herein on several different vehicles and the corresponding relative improvement in fuel economy. FIG. 21 further illustrates comparative fuel economy test data of the presently disclosed technology.

While the method and apparatus have been described in terms of what are presently considered to be the most practical and preferred embodiments, it is to be understood that the disclosure need not be limited to the disclosed embodiments. It is intended to cover various modifications and similar arrangements included within the spirit and scope of the claims, the scope of which should be accorded the broadest interpretation so as to encompass all such modifications and similar structures. The present disclosure includes any and all embodiments of the following claims.

It should also be understood that a variety of changes may be made without departing from the essence of the invention. Such changes are also implicitly included in the description. They still fall within the scope of this invention. It should be understood that this disclosure is intended to yield a patent covering numerous aspects of the invention both independently and as an overall system and in both method and apparatus modes.

Further, each of the various elements of the invention and claims may also be achieved in a variety of manners. This disclosure should be understood to encompass each such variation, be it a variation of an embodiment of any apparatus embodiment, a method or process embodiment, or even merely a variation of any element of these. Particularly, it should be understood that as the disclosure relates to elements of the invention, the words for each element may be expressed by equivalent apparatus terms or method terms—even if only the function or result is the same.

Such equivalent, broader, or even more generic terms should be considered to be encompassed in the description of each element or action. Such terms can be substituted where desired to make explicit the implicitly broad coverage to which this invention is entitled. It should be understood that all actions may be expressed as a means for taking that action or as an element which causes that action. Similarly, each physical element disclosed should be understood to encompass a disclosure of the action which that physical element facilitates.

Any patents, publications, or other references mentioned in this application for patent are hereby incorporated by reference. In addition, as to each term used it should be understood that unless its utilization in this application is inconsistent with such interpretation, common dictionary definitions should be understood as incorporated for each term and all definitions, alternative terms, and synonyms such as contained in at least one of a standard technical dictionary recognized by artisans and the Random House Webster's Unabridged Dictionary, latest edition are hereby incorporated by reference.

Finally, all references listed in the Information Disclosure Statement or other information statement filed with the application are hereby appended and hereby incorporated by reference; however, as to each of the above, to the extent that such information or statements incorporated by reference might be considered inconsistent with the patenting of this/these invention(s), such statements are expressly not to be considered as made by the applicant. In this regard it should be understood that for practical reasons and so as to avoid adding potentially hundreds of claims, the applicant has presented claims with initial dependencies only.

Support should be understood to exist to the degree required under new matter laws—including but not limited to United States Patent Law 35 USC 132 or other such laws—to permit the addition of any of the various dependencies or other elements presented under one independent claim or concept as dependencies or elements under any other independent claim or concept.

To the extent that insubstantial substitutes are made, to the extent that the applicant did not in fact draft any claim so as to literally encompass any particular embodiment, and to the extent otherwise applicable, the applicant should not be understood to have in any way intended to or actually relinquished such coverage as the applicant simply may not have been able to anticipate all eventualities; one skilled in the art, should not be reasonably expected to have drafted a claim that would have literally encompassed such alternative embodiments.

Further, the use of the transitional phrase "comprising" is used to maintain the "open-end" claims herein, according to traditional claim interpretation. Thus, unless the context requires otherwise, it should be understood that the term "comprise" or variations such as "comprises" or "comprising", are intended to imply the inclusion of a stated element or step or group of elements or steps but not the exclusion of any other element or step or group of elements or steps. Such terms should be interpreted in their most expansive forms so as to afford the applicant the broadest coverage legally permissible.

The above specification, examples, and data provide a complete description of the structure and use of exemplary embodiments of the invention. Since many embodiments of the invention can be made without departing from the spirit and scope of the invention, the invention resides in the claims hereinafter appended. Furthermore, structural features of the different embodiments may be combined in yet another embodiment without departing from the recited claims.

What is claimed is:

1. A throttleable venturi comprising:

an outer housing;

a central pipe extending through the outer housing and having an open end and a substantially closed end, wherein a first separate fluid stream is configured to flow through the central pipe and exit the central pipe via at least one exhaust outlet oriented between the open end and the substantially closed end of the central pipe; and an effective throat oriented between the outer housing and the central pipe, the effective throat with an adjustable size defined by a mass flow ratio of the first separate fluid stream to a second separate fluid stream flowing between the outer housing and the central pipe and merging with the first fluid stream at the effective throat of the venturi.

2. The throttleable venturi of claim 1, wherein the effective throat is located downstream of a physical throat of the venturi.

3. The throttleable venturi of claim 1, wherein the second fluid stream is an ambient fluid stream traveling through the effective throat of the venturi at greater than about Mach 0.3 and the first fluid stream is a combustion exhaust fluid stream injected into the effective throat of the venturi at less than about Mach 0.3.

4. The throttleable venturi of claim 1, wherein the venturi provides greater than about 1 psi negative gauge pressure on the combustion exhaust fluid stream when the mass flow ratio of the second fluid stream to the first fluid stream ranges from 1:1 to 10:1.

5. The throttleable venturi of claim 1 further comprising:
a mixing region downstream of the effective throat where the first separate fluid stream and the second separate fluid stream are mixed together into a mixed fluid stream.

6. The throttleable venturi of claim 5, further comprising:
a divergent exhaust cone that allows the mixed fluid stream to separate from a surface of the exhaust cone at a location downstream of the effective throat based on the size of the effective throat.

7. The throttleable venturi of claim 5, further comprising:
one or more vortex generators oriented within the mixed fluid stream that imparts a spiral motion to the mixed fluid stream.

8. The throttleable venturi of claim 1, further comprising:
one or more vortex generators oriented within one or both of the first separate fluid streams and the second separate fluid stream that impart a spiral motion to one or both of the first separate fluid streams and the second separate fluid stream.

9. The throttleable venturi of claim 1, wherein the effective throat decreases in size with an increase in the mass flow ratio of the second separate fluid stream to the first separate fluid stream.

10. The throttleable venturi of claim 1, wherein the effective throat further has an adjustable location within the venturi defined by the mass flow rate of one or both of the second separate fluid stream and the first separate fluid stream.

11. The throttleable venturi of claim 1, wherein the effective throat moves downstream within the venturi with an increase in the mass flow ratio of the second separate fluid stream to the first separate fluid stream.

12. The throttleable venturi of claim 1, wherein an interior surface contour of the venture is defined by NACA profile 4424.

13. The throttleable venturi of claim 1, wherein an interior surface contour of the venture is defined by a lifting body shape.

14. A method comprising:
exiting a first separate fluid stream from a central pipe in a throttleable venturi, wherein the central pipe has an open end and a substantially closed end, and wherein the first separate fluid stream is configured to flow through the central pipe and exit the central pipe via at least one exhaust outlet oriented between the open end and the substantially closed end of the central pipe; and
injecting the first fluid stream into a second fluid stream flowing between the outer housing and the central pipe and merging with the second fluid stream at an effective throat of the throttleable venturi, wherein the effective throat is oriented between the outer housing and the central pipe and wherein the effective throat has an adjustable size defined by a mass flow ratio of the second fluid stream to the first fluid stream.

15. The method of claim 14, wherein the effective throat is located downstream of a physical throat of the venturi.

16. The method of claim 14, wherein the second fluid stream is an ambient fluid stream traveling through the effective throat of the venturi at greater than about Mach 0.3 and the first fluid stream is a combustion exhaust fluid stream injected into the effective throat of the venturi at less than about Mach 0.3.

17. The method of claim 14, wherein the venturi provides greater than about 1 psi negative gauge pressure on the first fluid stream when the mass flow ratio of the second fluid stream to the first fluid stream ranges from 1:1 to 10:1.

18. The method of claim 14, further comprising:
mixing the first separate fluid stream with the second separate fluid stream downstream of the effective throat to create a mixed fluid stream.

19. The method of claim 18, further comprising:
separating the mixed fluid stream from a surface of a divergent exhaust cone at a location downstream of the effective throat based on the size of the effective throat.

20. The method of claim 18, further comprising:
imparting a spiral motion to the mixed fluid stream.

21. The method of claim 14, further comprising:
imparting a spiral motion to one or both of the first fluid stream and the second fluid stream.

22. The method of claim 14, wherein the effective throat decreases in size with an increase in the mass flow ratio of the second separate fluid stream to the first separate fluid stream.

23. The method of claim 14, wherein the effective throat further has an adjustable location within the venturi defined by a mass flow rate of one or both of the second fluid stream and the first fluid stream.

24. The method of claim 23, wherein the effective throat moves downstream within the venturi with an increase in the mass flow ratio of the second separate fluid stream to the first separate fluid stream.

25. The method of claim 14, wherein an interior surface contour of the venturi is defined by NACA profile 4424.

26. The method of claim 14, wherein an interior surface contour of the venturi is defined by a lifting body shape.

27. A throttleable exhaust venturi comprising:
an outer housing
a central pipe extending through the outer housing and having an open end and a substantially closed end;
an ambient fluid path oriented between the central pipe and the outer housing that accelerates an ambient fluid stream to subsonic velocities greater than about Mach 0.3 at an effective venturi throat;
a combustion engine exhaust outlet in the central pipe between the open end and the closed end that discharges a combustion engine exhaust stream into the ambient fluid stream at the effective venturi throat, wherein the effective venturi throat changes size and location within the venturi depending on a mass flow ratio of the ambient fluid stream fluid stream to the combustion engine exhaust stream;
a mixing region downstream of the effective throat where the combustion engine exhaust stream and the ambient fluid stream are mixed together into a mixed fluid stream; and
one or more vortex generators oriented within the mixed fluid stream that imparts a spiral motion to the mixed fluid stream.

* * * * *